US010787019B2

(12) United States Patent
Mundy

(10) Patent No.: US 10,787,019 B2
(45) Date of Patent: Sep. 29, 2020

(54) SECURITY DEVICES AND METHODS FOR THEIR MANUFACTURE

(71) Applicant: DE LA RUE INTERNATIONAL LIMITED, Basingstoke, Hampshire (GB)

(72) Inventor: Darryl Mundy, Polegate (GB)

(73) Assignee: DE LA RUE INTERNATIONAL LIMITED, Basingstoke (GB)

( * ) Notice: Subject to any disclaimer, the term of this patent is extended or adjusted under 35 U.S.C. 154(b) by 0 days.

(21) Appl. No.: 16/607,488

(22) PCT Filed: May 9, 2018

(86) PCT No.: PCT/GB2018/051233

§ 371 (c)(1),
(2) Date: Oct. 23, 2019

(87) PCT Pub. No.: WO2018/206936

PCT Pub. Date: Nov. 15, 2018

(65) Prior Publication Data

US 2020/0139744 A1 May 7, 2020

(30) Foreign Application Priority Data

May 10, 2017 (GB) ..... 1707464.2

(51) Int. Cl.
*B42D 25/387* (2014.01)
*B42D 25/21* (2014.01)
(Continued)

(52) U.S. Cl.
CPC ..... *B42D 25/387* (2014.10); *B41M 3/144* (2013.01); *B42D 25/21* (2014.10); *B42D 25/355* (2014.10)

(58) Field of Classification Search
CPC .... B42D 25/387; B42D 25/21; B42D 25/355; B41M 3/14
(Continued)

(56) References Cited

U.S. PATENT DOCUMENTS

2005/0279235 A1* 12/2005 Barthram ..... B41M 3/144 101/483

FOREIGN PATENT DOCUMENTS

EP 0 059 056 A1 9/1982
EP 2 075 767 A1 7/2009
(Continued)

OTHER PUBLICATIONS

Jul. 3, 2018 Search Report issued in International Patent Application No. PCT/GB2018/051233.
(Continued)

*Primary Examiner* — Justin V Lewis
(74) *Attorney, Agent, or Firm* — Oliff PLC

(57) ABSTRACT

A security device is disclosed, comprising: a first ink (21) and a second ink (22) each arranged in respective laterally offset first and second regions of the security device, the first and second inks each comprising a respective luminescent material which both luminesce in response to irradiation at at least one excitation wavelength in the ultra-violet spectrum, the first and second inks each exhibiting substantially the same non-luminescent visible colour as one another when illuminated with visible light in the absence of the at least one excitation wavelength, and the first and second inks each exhibiting visible colours which are different from the non-luminescent visible colour and from one another when illuminated with a combination of visible light and the at least one excitation wavelength; a third ink (23) arranged in a third region of the device laterally offset from the first and
(Continued)

Figure 1:
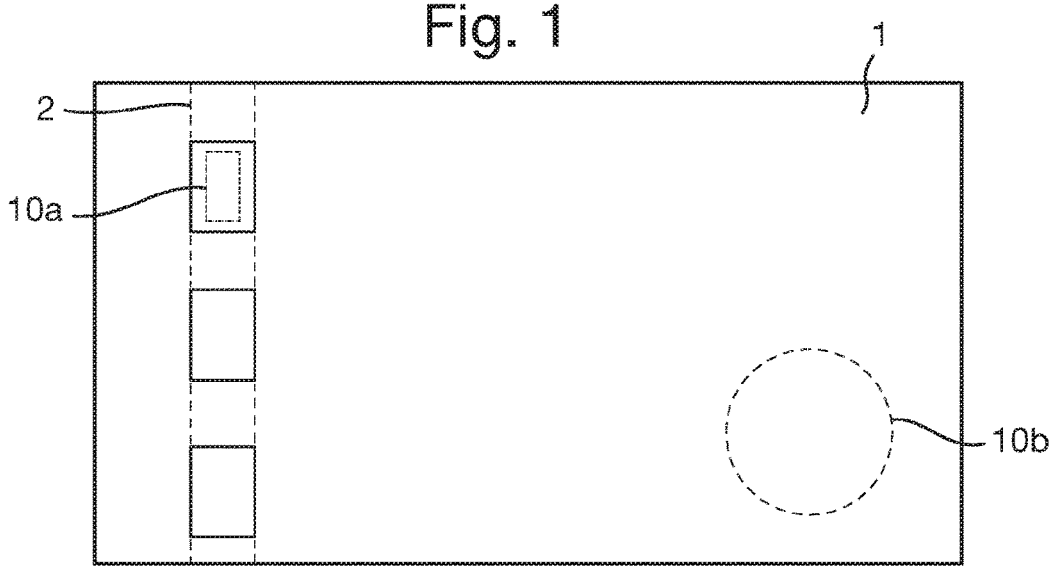

second regions of the device, the third ink not luminescing in response to the at least one excitation wavelength, and the third ink exhibiting substantially the same non-luminescent visible colour as the first and second inks when illuminated with visible light in the absence of the at least one excitation wavelength; and a fourth ink (24) arranged in a masking pattern which partially overlaps one or more portions of the first ink in the first region and/or of the second ink in the second region, the fourth ink not luminescing in response to the at least one excitation wavelength, and the fourth ink exhibiting a different visible colour from the non-luminescent visible colour of the first, second and third inks when illuminated with visible light in the absence of the at least one excitation wavelength. When the security device is illuminated with visible light in the absence of the at least one excitation wavelength, the first, second and third regions together appear as one continuous pattern in the non-luminescent visible colour, the fourth ink obscuring the presence of more than one ink forming the continuous pattern, and when the security device is illuminated with a combination of visible light and the at least one excitation wavelength, the first and second regions become visibly distinct from each other and from the remainder of the continuous pattern.

20 Claims, 12 Drawing Sheets

(51) Int. Cl.
*B42D 25/355* (2014.01)
*B41M 3/14* (2006.01)
*B42D 25/378* (2014.01)

(58) Field of Classification Search
USPC ..... 283/67, 70, 72, 74, 91, 94, 98, 901
See application file for complete search history.

(56) References Cited

FOREIGN PATENT DOCUMENTS

| | | | |
|---|---|---|---|
| JP | 2013-129095 | A | 7/2013 |
| WO | 00/39391 | A1 | 7/2000 |
| WO | 2004/050376 | A1 | 6/2004 |
| WO | 2005/047013 | A2 | 5/2005 |
| WO | 2011/039199 | A1 | 4/2011 |
| WO | 2011/135344 | A1 | 11/2011 |
| WO | 2014/184738 | A2 | 11/2014 |
| WO | 2014/184739 | A2 | 11/2014 |
| WO | 2017/055824 | A1 | 4/2017 |

OTHER PUBLICATIONS

Jul. 3, 2018 Written Opinion of the International Searching Authority issued in International Patent Application No. PCT/GB2018/051233.

Oct. 30, 2017 Office Action and Search Report issued in British Patent Application No. 1707464.2.

* cited by examiner

SECURITY DEVICES AND METHODS FOR THEIR MANUFACTURE

This invention relates to security devices for authenticating articles of value including security documents such as banknotes, cheques, passports, identity cards, certificates of authenticity, fiscal stamps and other secure documents. Methods for manufacturing such security elements are also disclosed.

Articles of value, and particularly documents of value such as banknotes, cheques, passports, identification documents, certificates and licences, are frequently the target of counterfeiters and persons wishing to make fraudulent copies thereof and/or changes to any data contained therein. Typically such objects are provided with a number of visible security devices for checking the authenticity of the object. By "security device" we mean a feature which it is not possible to reproduce accurately by taking a visible light copy, e.g. through the use of standardly available photocopying or scanning equipment. Examples include features based on one or more patterns such as microtext, fine line patterns, latent images, venetian blind devices, lenticular devices, moiré interference devices and moiré magnification devices, each of which generates a secure visual effect. Other known security devices include holograms, watermarks, embossings, perforations and the use of colour-shifting or luminescent/fluorescent inks. Common to all such devices is that the visual effect exhibited by the device is extremely difficult, or impossible, to copy using available reproduction techniques such as photocopying. Security devices exhibiting non-visible effects such as magnetic materials may also be employed.

One known class of security device are those which make use of luminescent substances (which term includes materials having fluorescent or phosphorescent properties). Such materials respond visibly to irradiation at certain wavelengths outside the visible spectrum, typically by emitting light of a particular colour characteristic of the material in question. The presence of such materials is therefore not readily detectable in normal illumination circumstances where the security device is illuminated with visible light only, but can be tested for by illuminating the security device with light of the appropriate wavelength, e.g. ultra-violet.

Luminescent security features therefore provide a distinctive, high visual impact effect which is memorable and easily identified. However, luminescent inks are becoming more readily available on the commercial market and hence are accessible to would-be counterfeiters. As such, more complex luminescent features are needed to make counterfeiting more difficult and hence increase the security level.

WO2004/050376 discloses examples of luminescent security devices having two regions which exhibit different colours under different viewing conditions. In preferred embodiments, the security device comprises two luminescent inks arranged in respective regions which have substantially the same visible colour when viewed under visible light, and both undergo a colour change to exhibit different visible colours (from one another) when viewed under a combination of visible light and UV. This is achieved for example by balancing, for each ink, the visible pigments against any visible colour of the luminescent substance(s) to make the two inks substantially match under visible illumination. The result is a security device with an enhanced, two-colour appearance under UV illumination. Further, the device achieves a significantly higher security level since it is much more difficult for would-be counterfeiters to access colour matched inks of this sort. Moreover, since the inks have a visible colour in standard (non-UV) illumination, there is exact register between what is visible under each of the viewing conditions: the peripheries of the at least two regions are the same when viewed under visible light only and when luminescing under UV. This is extremely difficult to imitate by any other means since for example placing visually transparent UV inks over (or under) a visibly coloured print will not achieve the necessary register between the two effects.

Devices of this sort are particularly effective if the presence of the two different inks cannot be discerned under visible (non-UV) illumination. In this case the feature would appear as if it were formed of a single ink and only when illuminated with the appropriate UV wavelength would the presence of the two different regions be revealed. This is achieved to a large extent by the colour-matched nature of the two inks which has the result that at least when viewed quickly or without close scrutiny the presence of the two regions goes unnoticed.

However, in some cases the non-UV colours of the two inks may not be an exact match and/or the two inks may have different levels of gloss. This can result in the presence of the two different inks being detectable by eye under visible light only. Whilst the visual distinction may be subtle this can reveal the presence of an otherwise hidden feature and thus significantly reduces its security level.

The present invention provides a security device, comprising:

- a first ink and a second ink each arranged in respective laterally offset first and second regions of the security device, the first and second inks each comprising a respective luminescent material which both luminesce in response to irradiation at at least one excitation wavelength in the ultra-violet spectrum, the first and second inks each exhibiting substantially the same non-luminescent visible colour as one another when illuminated with visible light in the absence of the at least one excitation wavelength, and the first and second inks each exhibiting visible colours which are different from the non-luminescent visible colour and from one another when illuminated with a combination of visible light and the at least one excitation wavelength;
- a third ink arranged in a third region of the device laterally offset from the first and second regions of the device, the third ink not luminescing in response to the at least one excitation wavelength, and the third ink exhibiting substantially the same non-luminescent visible colour as the first and second inks when illuminated with visible light in the absence of the at least one excitation wavelength; and
- a fourth ink arranged in a masking pattern which partially overlaps one or more portions of the first ink in the first region and/or of the second ink in the second region, the fourth ink not luminescing in response to the at least one excitation wavelength, and the fourth ink exhibiting a different visible colour from the non-luminescent visible colour of the first, second and third inks when illuminated with visible light in the absence of the at least one excitation wavelength;

whereby when the security device is illuminated with visible light in the absence of the at least one excitation wavelength, the first, second and third regions together appear as one continuous pattern in the non-luminescent visible colour, the fourth ink obscuring the presence of more than one ink forming the continuous pattern, and when the security device is illuminated with a combination of visible light and the at least one excitation wavelength, the first and second regions become visibly distinct from each other and from the remainder of the continuous pattern.

By providing the security device with a third ink in substantially the same colour as the first and second (UV) inks, but without a UV response, together with a fourth ink arranged as a masking pattern in a different colour, the presence of the two different UV inks is very effectively concealed when the device is viewed in only visible light. Together, the first, second and third regions form a continuous pattern in the sense that they appear to be formed all of a single ink (though it should be noted that this pattern need not be continuous in terms of its spatial layout) when viewed without UV. Thus, the UV feature is hidden to a first degree since its lateral extent is not readily distinguishable from that of the third, non-luminescent ink. The masking pattern formed by the fourth ink further conceals the presence of the UV feature by (only) partially overlapping parts of the first and/or second UV ink in a different colour. Any pattern which achieves this concealing effect could be used as the masking pattern and examples are provided below.

The concealing effect can be a result of one or more different mechanisms: firstly, simply breaking up the continuous pattern formed by the first, second and third inks with a pattern in a different colour in this way has the effect that the eye is no longer comparing only three very similar or identical colours against one another, but rather also requiring it to compare these against a fourth, different colour. There will be a greater difference between the colour of each of the first, second and third inks and the fourth ink, as compared with any difference between the colours of the first, second and third inks themselves, and as a result any such difference will be visually diminished, as will any difference in gloss level. As such, the eye will be drawn to the strongly contrasting masking pattern and away from any subtle patterning apparent between the three other inks. Secondly, in a preferred embodiment the masking pattern can be configured to induce visual confusion, distracting the eye from any patterning in the three matched inks. This obscures the arrangement of the first, second and third regions. Thirdly, in a preferred embodiment, the masking pattern can be configured to includes elements which at least partially conceal peripheries of the first, second and/or third regions, preferably elements which intersect the peripheries. In this way the lateral extent of the regions is visually broken up by the masking pattern. Any combination of these mechanisms can be utilised.

The masking pattern may partially overlap only the first or only the second UV ink, but more preferably partially overlaps both. It should be appreciated that the overlapping of the first and/or second inks by the masking pattern will be only partial and not all-over. That is, at least some parts of the first and second regions will be left uncovered by the masking pattern. The same applies to the third region, which the masking pattern preferably partially overlaps also.

Throughout this specification, the term "visible colour" means a colour which can be seen by the naked human eye under the stated illumination conditions. This includes achromatic hues such as black, grey, white, silver etc., as well as chromatics such as red, blue, yellow, green, brown etc. The term "non-luminescent visible colour" simply refers to the colour exhibited by the first, second and third inks when viewed under visible light in the absence of the at least one excitation wavelength. "Substantially the same" colours are those which appear the same as one another in a cursory inspection (by the naked human eye) although they may not be an exact match under close examination. By the same logic, "different" colours are those which clearly present a contrast to one another that is visible to the naked human eye even without a close inspection. The difference might be in terms of the colour's hue or tone or both.

For example, in preferred embodiments, two colours will be considered substantially the same as one another if the Euclidean distance $\Delta E^*_{ab}$ between them in CIELAB colour space (i.e. the CIE 1976 L*a*b* colour space) is less than 3, more preferably less than 2.3. The value of $\Delta E^*_{ab}$ is measured using the formula $$\Delta E^*_{ab}=\sqrt{(\Delta L^*)^2+(\Delta a^*)^2+(\Delta b^*)^2}$$

Where ΔL*, Δa* and Δb* are the distance between the two colours along the L*, a* and b* axes respectively (see "Digital Color Imaging Handbook" (1.7.2 ed.) by G. Sharma (2003), CRC Press, ISBN 0-8493-0900-X, pages 30 to 32). Conversely, if $\Delta E^*_{ab}$ is greater than or equal to 3 (or, in more preferred embodiments, greater than or equal to 2.3), the two colours will be considered different. The colour difference $\Delta E^*_{ab}$ can be measured using any commercial spectrophotometer, such as those available from Hunterlab of Reston, Va., USA.

"Visible light" refers to light having a wavelength within the visible spectrum, which is approximately 400 to 750 nm. It is most preferable that the visible light is white light, i.e. contains substantially all the visible wavelengths in more or less even proportion. The viewing condition "illumination with visible light in the absence of the at least one excitation wavelength" may also be referred to herein for brevity as "visible light", "visible light only" or "non-UV light". The ultra-violet spectrum typically comprises wavelengths from about 200 nm to about 400 nm.

The first, second and/or third regions could comprise a single contiguous region of the security device. However, in more preferred examples, the first, second and/or third region(s) comprise a plurality of sub-regions spaced from one another. This enables the creation of much more complex designs. The sub-regions of any one region may be spaced from one another by uninked areas of the security device and/or by sub-regions of one or both of the other regions and/or by areas of other, contrasting ink(s).

The laterally offset regions may be spaced, abut or even partially (but not completely) overlap. This applies too between sub-regions of the respective regions if formed in that way. The relative arrangement of the regions can also be different in different areas of the continuous pattern formed by the three regions.

Hence in a preferred embodiment, at least in an area of the continuous pattern, the first and second regions are spaced from one another, and preferably from the third region, by one or more gap(s) which are ink-free or of a colour contrasting with the non-luminescent colour of the first and second inks whereby at least some of the peripheries of the regions are visible in the continuous pattern when the security device is illuminated with visible light in the absence of the at least one excitation wavelength. This arrangement is advantageous since it highlights the registration between the visible colour of each ink and its UV effect, which will match exactly.

Nonetheless, it is desirable for the spacing between the inks to be small so that the multi-coloured appearance under UV light can be intricate. In conventional devices such close spacing between different luminescent inks has proved difficult since this tends to emphasise any difference in colour or gloss level between the inks, revealing the appearance of the UV feature. However given the measures against this provided by the present invention, such limitations are now overcome. Hence, preferably, the first and second regions are spaced from one another by less than 1 mm, more preferably less than 0.5 mm, at least at one location in the continuous pattern.

For the same reason, it is desirable that, at least in an area of the continuous pattern, the first and second regions abut one another, and preferably abut the third region.

In still further embodiments, at least in an area of the continuous pattern, the first and second regions partially overlap one another, and preferably partially overlap the third region. This provides the further advantage that where the first and second inks overlap, a third different colour will be exhibited by the security device when irradiated with the excitation wavelength. Overlapping of this sort can be achieved by rainbow printing of the first and second inks.

The first and second regions can be configured (either individually or together) to have any graphical form which may or may not be related to the appearance or information content (if any) of the continuous pattern formed by the first, second and third inks and/or of the masking pattern. In preferred embodiments, the first and/or second regions either individually or in combination define one or more indicia, preferably one or more alphanumeric characters, symbols, currency identifiers, logos or microtext.

In some preferred implementations, the continuous pattern formed by the first, second and third regions comprises a regular or periodic pattern, preferably a regular grid of pattern elements arrayed across the security device, different sub-sets of the pattern elements being formed of each of the first, second and third inks. The pattern elements could be lines (rectilinear or otherwise), elongate elements, dots, squares, etc. but more preferably are indicia, e.g. symbols or alphanumeric characters. Most preferably such indicia will be in the form of microtext, i.e. too small to be immediately discernible to the naked eye but which become legible on close inspection and/or magnification. The regular or periodic pattern could be uniform across its whole area, but more advantageously the regular or periodic pattern is spatially modulated across the security device to provide areas of different visual contrast when the security device is illuminated with visible light in the absence of the at least one excitation wavelength. For example the regular or periodic pattern may preferably exhibit a halftone image, such as a component of a portrait or other scene. For instance, the halftone pattern formed by the first, second and third inks may contribute shading to a portrait or other picture which is further defined by the masking pattern in the fourth ink. Examples of graphics of this sort are disclosed in WO-A-2011/135344, in which the screened working comprising indicia could instead be formed of the presently disclosed first, second and third inks, with the fourth ink masking pattern being formed as the other screened working disclosed therein.

The variation in tone can be achieved by changing the size, line weight or ink density of the pattern elements forming the screen across the security device to create areas of contrast.

The masking pattern can take many different forms provided it achieves its function of obscuring the presence of multiple inks forming the continuous pattern. In some preferred embodiments, the masking pattern formed by the fourth ink is configured to interlock with at least portions of the continuous pattern formed by the first, second and third inks. For instance the continuous pattern could appear in visible light as a complex arrangement of geometrical shapes and the masking pattern may appear to complement this by including the same shapes or including elements which follow lines in the continuous pattern.

In preferred implementations, the masking pattern may comprise any of: a line pattern, a guilloche structure, a screened working, a halftone image, a portrait or other graphic. Advantageously, the tone of the masking pattern may vary across the security device in order to convey information, e.g. in the form of at least a component of a half tone image as mentioned above.

The fourth ink may be of any colour different from the non-luminescent colour of the first, second and third inks in terms of its tone, hue or both. However in particularly preferred embodiments, the visible colour exhibited by the fourth ink when illuminated with visible light in the absence of the at least one excitation wavelength is darker in hue and/or tone than the non-luminescent colour of the first, second and third inks. This has been found to disguise the presence of the UV feature particularly well whilst also giving the security element an appearance similar to that of a conventional portrait or other security graphic which helps to distract further.

The first and second inks will contain different luminescent materials in order to exhibit different colours from one another under UV illumination. The materials may have different response spectra (i.e. may each be responsive to a different range of UV wavelengths), but it necessary that both luminescent materials have at least one UV wavelength to which they are responsive in common. In this way, at least when illuminated with that UV wavelength, both the first and second inks will respond. Preferably, the first and second inks luminesce in response to at least one UV wavelength in the range 200 to 400 nm, more preferably 235 to 380 nm. More preferably there will be a waveband of more than one excitation wavelength common to both materials. In particularly preferred implementations, the first and second inks will each be responsive to a wide range of UV wavelengths, and still preferably the first and second inks luminesce in response to any UV wavelength in the range 235 to 380 nm. In this case it should be understood that it is not necessary for all such wavelengths to be included in the illuminating irradiation to elicit a response from both material—just any one wavelength within that range.

Typically, unless the luminescent materials have the desired body colour, the first and second inks may additionally comprise other substances, such as non-luminescent pigments and/or dyes, in order to create the desired colour in visible light. These may or may not be the same as the non-luminescent pigments and/or dyes in the third ink, since if the luminescent materials in the inks have a colour which is visible in visible light, the first and second inks may each need to contain different or additional visible pigment and/or dyes to account for this and match the colour of the third ink. WO2004/050376 discloses examples of ink compositions suitable for use as the first, second and third inks, and further examples of appropriate inks will be given below.

The security element could additionally include one or more further inks which may or may not be luminescent, e.g. inks of different colours, in order to further enhance the complexity of the security element. The security element could alternatively or in addition comprise one or more further security enhancing features, most preferably machine-detectable features such as a magnetic substance, an electrically conductive substance, a metal layer, an IR absorbing material or an optically variable ink (i.e. one of which the appearance varies with viewing angle), each of which could be patterned or provided in the form of a code. Any of these materials could optionally be incorporated into one of the first, second, third and fourth inks. For example, it would be particularly advantageous for the fourth ink to be a magnetic, metallic or optically variable ink in order to further enhance the security level of the device. The use of a metallic or optically variable ink in the masking pattern will also contribute to its obscuring effect by further distracting the eye from the first, second and third inks.

Preferably, the first, second, third and fourth inks are each registered to one another. That is, within a set of such security elements, the relative position of the four inks will be substantially the same on each security element. The present invention also provides a plurality of security elements in which the inks are registered in this way.

Advantageously, the first, second, third and fourth inks are each printed inks on a substrate, preferably on the same surface of the substrate. The substrate could be opaque, translucent or transparent. If the substrate is translucent or transparent, one or more of the first, second, third and fourth inks could be printed on a first side of the substrate and the other(s) printed on a second side such that the collective appearance is viewed when the device is viewed in transmitted light or against a light background. Otherwise, the device may be designed for viewing in reflected light. The substrate could be of any suitable material but is preferably a paper, polymer or paper-polymer hybrid substrate. If the substrate has a colour this should preferably be a colour (including white) which contrasts with that of the non-luminescent colour of the first, second and third inks and preferably also with that of the fourth ink.

The substrate could be of a type suitable for forming a security article such as a security thread or similar, for later incorporation into or onto another object, in which case the substrate is typically relatively thin, e.g. up to around 70 microns.

Alternatively the substrate could be adapted to form the core of a security document, such as a banknote. In which case it will typically have a greater thickness, e.g. between 70 and 200 microns.

The present invention further provides a security article comprising a security device as described above, wherein the security article is preferably a security thread, stripe, patch or foil. Also provided is a security document comprising such a security device or security article, wherein the security document is preferably a banknote, identity card, passport, cheque, stamp, visa, bond, certificate or voucher.

Also disclosed is a method of manufacturing a security device, the method comprising applying onto a substrate:

a first ink and a second ink each arranged in respective laterally offset first and second regions of the security device, the first and second inks each comprising a respective luminescent material which both luminesce in response to irradiation at at least one excitation wavelength in the ultra-violet spectrum, the first and second inks each exhibiting substantially the same non-luminescent visible colour as one another when illuminated with visible light in the absence of the at least one excitation wavelength, and the first and second inks each exhibiting visible colours which are different from the non-luminescent visible colour and from one another when illuminated with a combination of visible light and the at least one excitation wavelength;

a third ink arranged in a third region of the device laterally offset from the first and second regions of the device, the third ink not luminescing in response to the at least one excitation wavelength, and the third ink exhibiting substantially the same non-luminescent visible colour as the first and second inks when illuminated with visible light in the absence of the at least one excitation wavelength; and a fourth ink arranged in a masking pattern which partially overlaps one or more portions of the first ink in the first region and/or of the second ink in the second region, the fourth ink not luminescing in response to the at least one excitation wavelength, and the fourth ink exhibiting a different visible colour from the non-luminescent visible colour of the first, second and third inks when illuminated with visible light in the absence of the at least one excitation wavelength; whereby when the security device is illuminated with visible light in the absence of the at least one excitation wavelength, the first, second and third regions together appear as one continuous pattern in the non-luminescent visible colour, the fourth ink obscuring the presence of more than one ink forming the continuous pattern, and when the security device is illuminated with a combination of visible light and the at least one excitation wavelength, the first and second regions become visibly distinct from each other and from the remainder of the continuous pattern.

The resulting security device provides all the benefits already discussed above.

Advantageously, the first, second, third and fourth inks are applied to the substrate by printing, preferably by lithographic, flexographic, offset, intaglio, screen, gravure printing, or digital printing techniques such as inkjet.

The first, second, third and fourth inks are preferably applied to the substrate in registration with one another. Hence, desirably, the first, second, third and fourth inks are applied to the substrate in the same, in-line application process.

For instance, each ink can be applied to the substrate sequentially in the same continuous printing process, or two or more of the inks could be applied in register to a transfer blanket or roller and then applied to the substrate simultaneously. If certain of the inks are applied to different surfaces of the substrate, this could be performed simultaneously.

Figure 7:
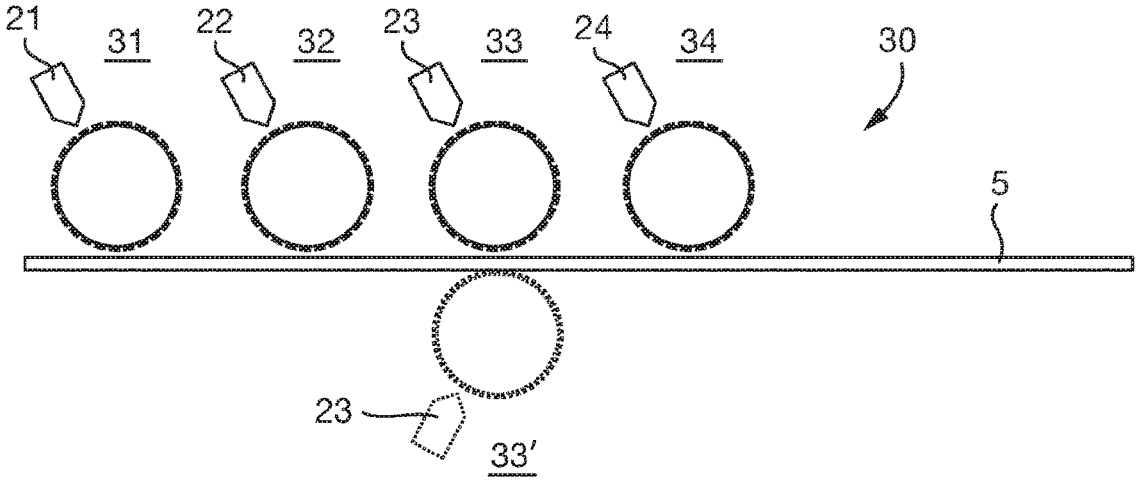
Figure 8:
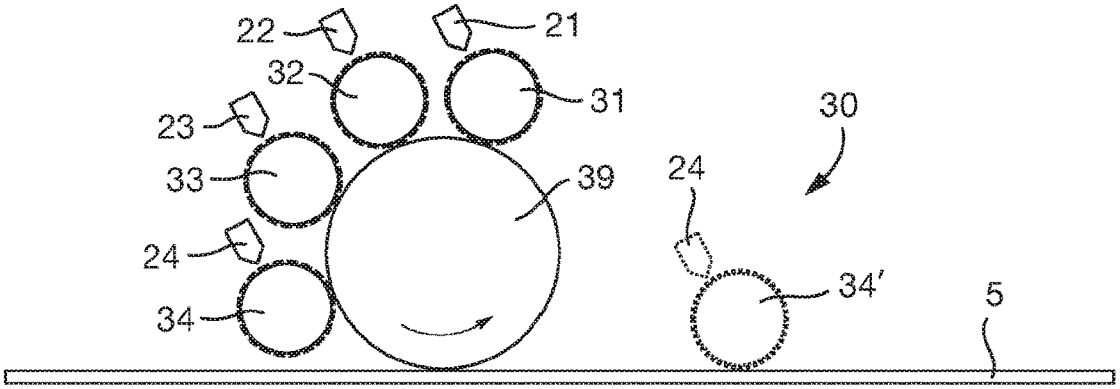
Figure 2A:
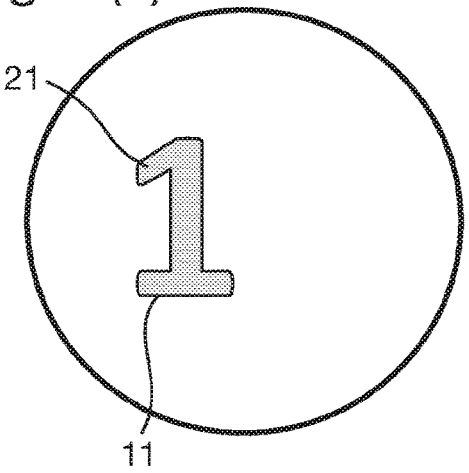
Figure 2B:
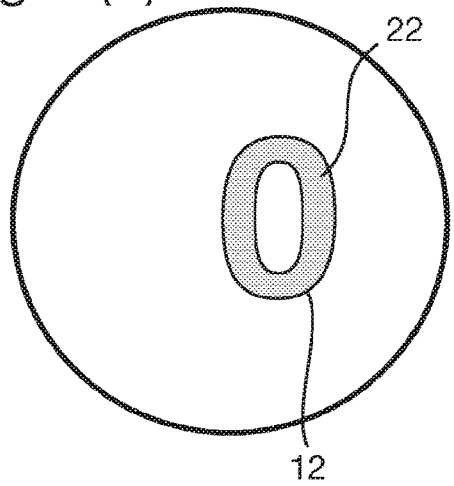
Figure 2C:
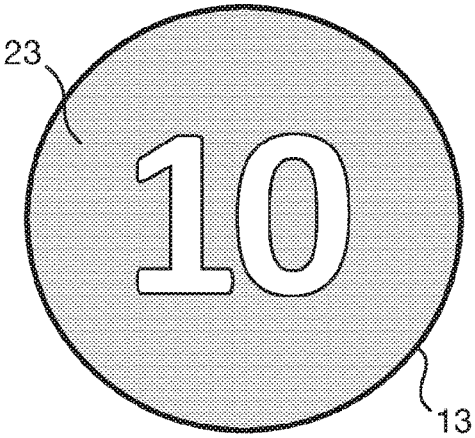
Figure 2D:
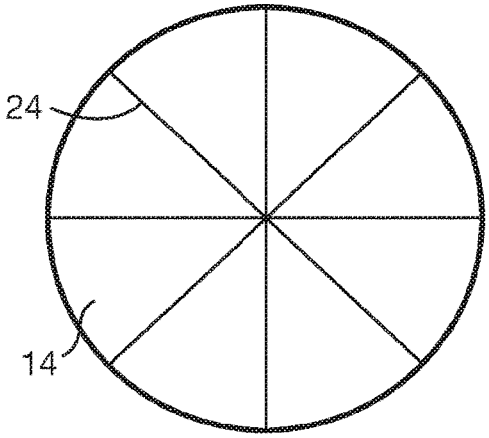
Figure 2E:
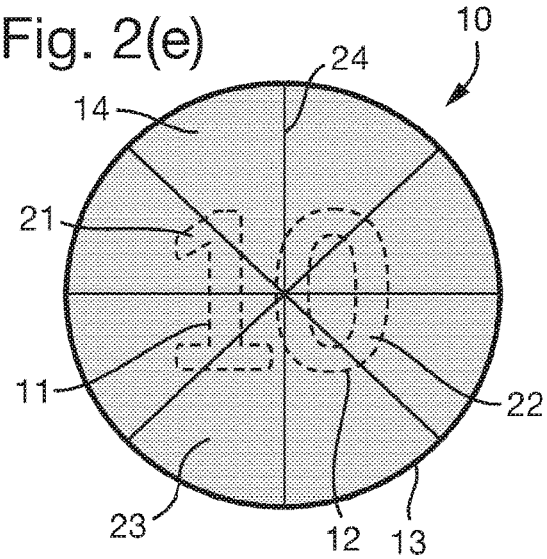
Figure 2F:
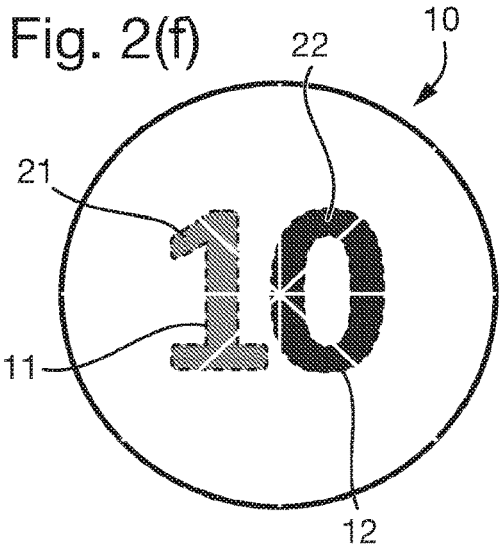
Figure 3A:
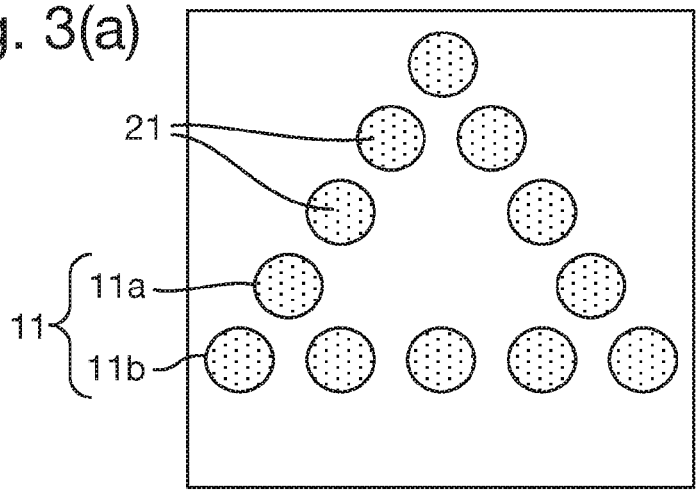
Figure 3B:
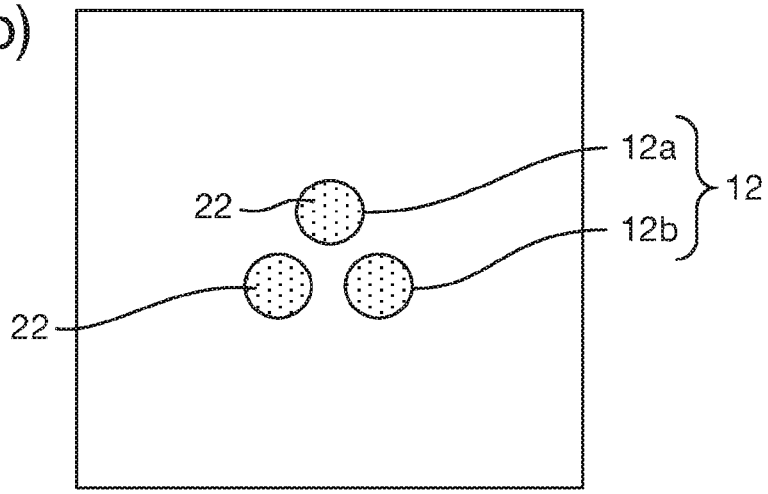
Figure 3C:
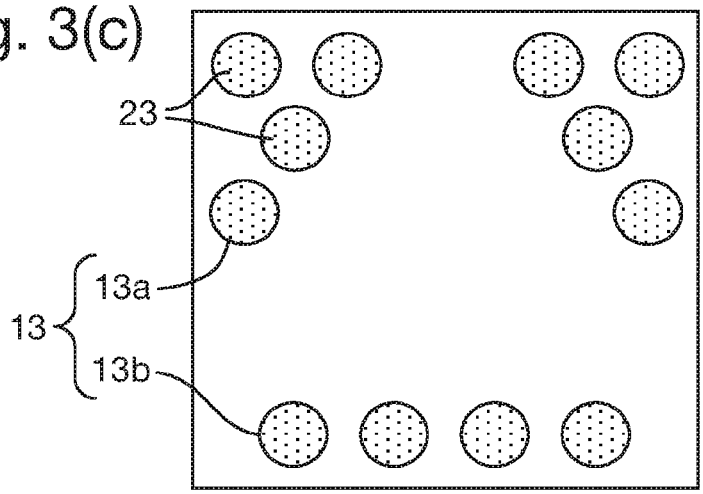
Figure 3D:
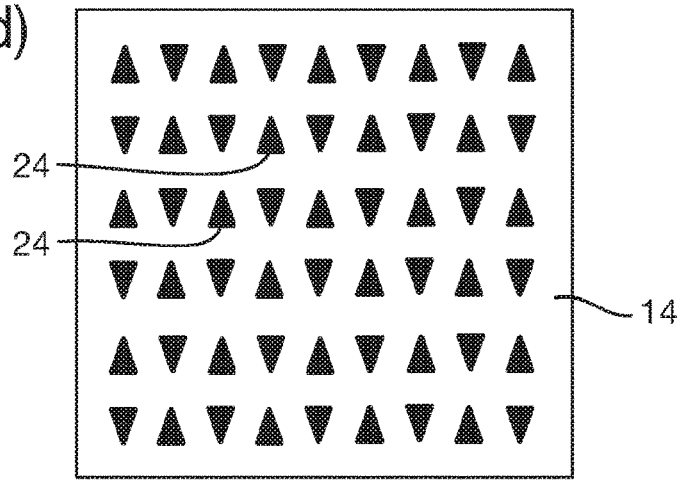
Figure 3E:
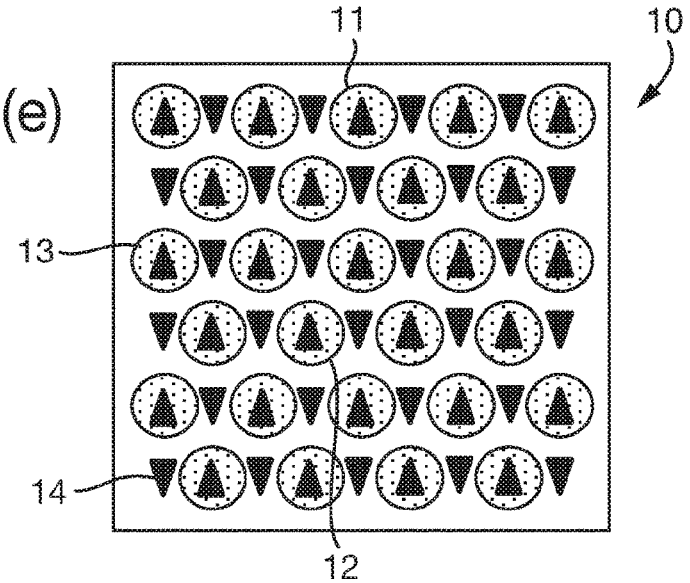
Figure 3F:
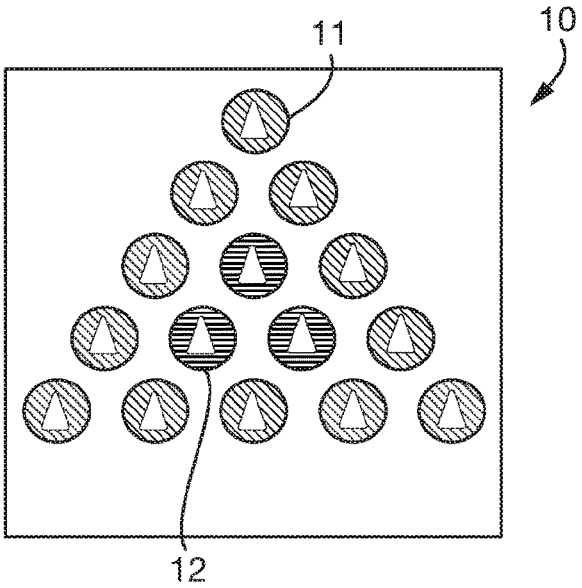
Figure 4A:
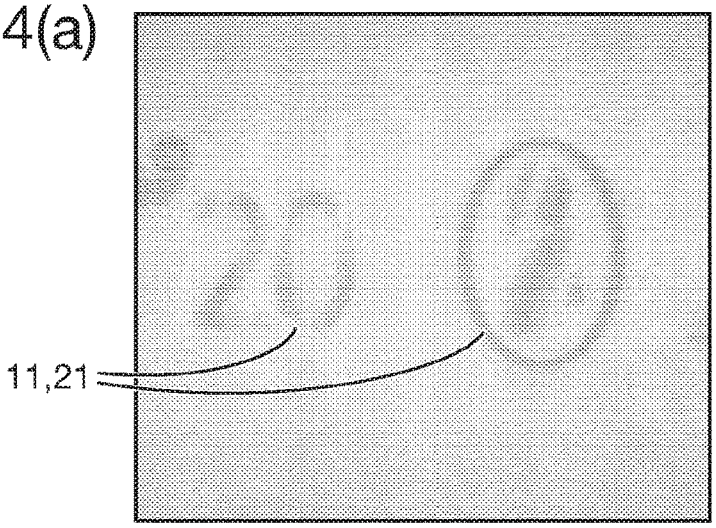
Figure 4B:
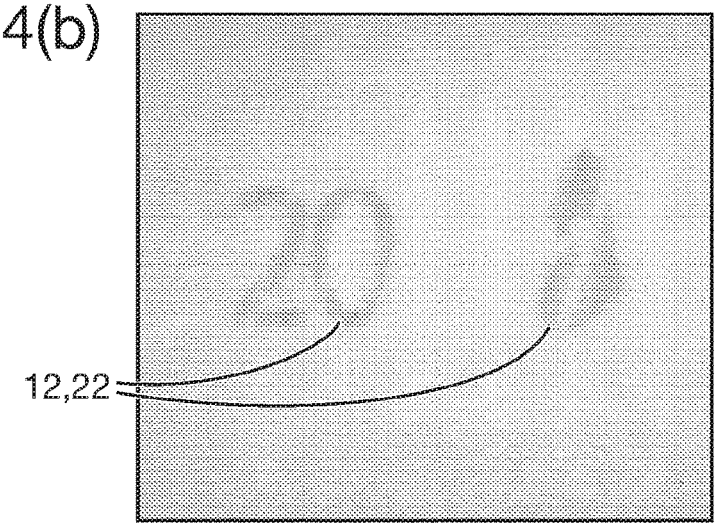
Figure 4C:
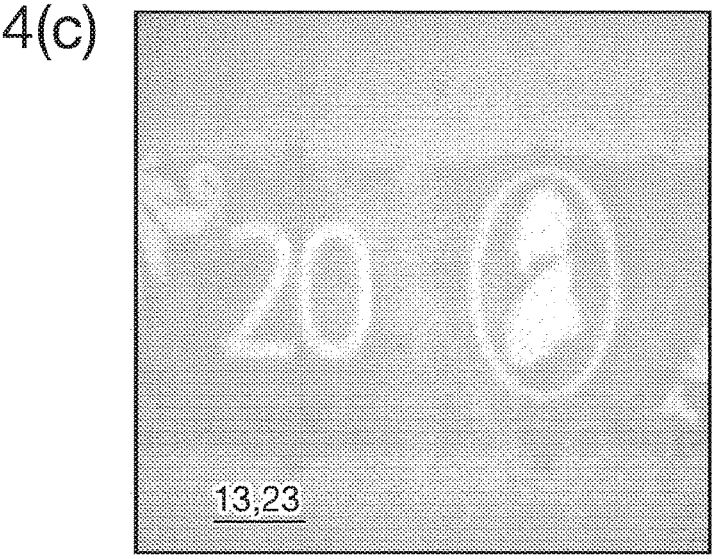
Figure 4D:
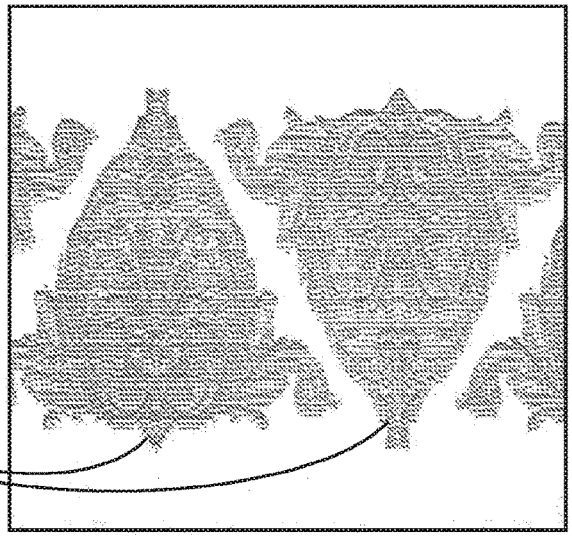
Figure 4E:
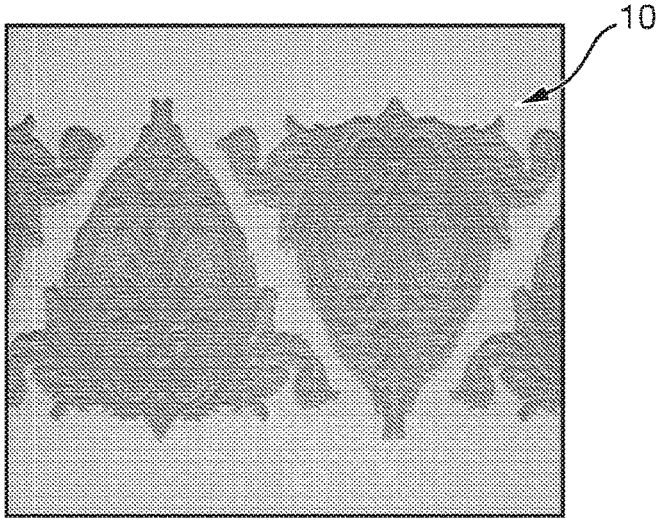
Figure 4F:
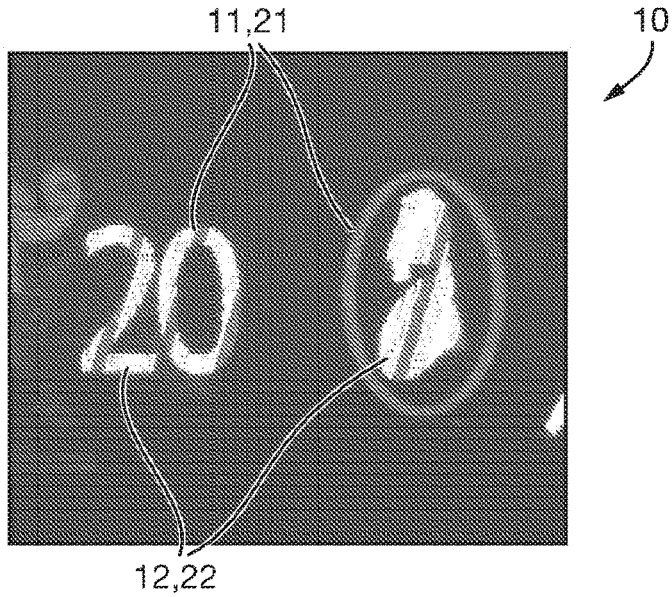
Figure 5A:
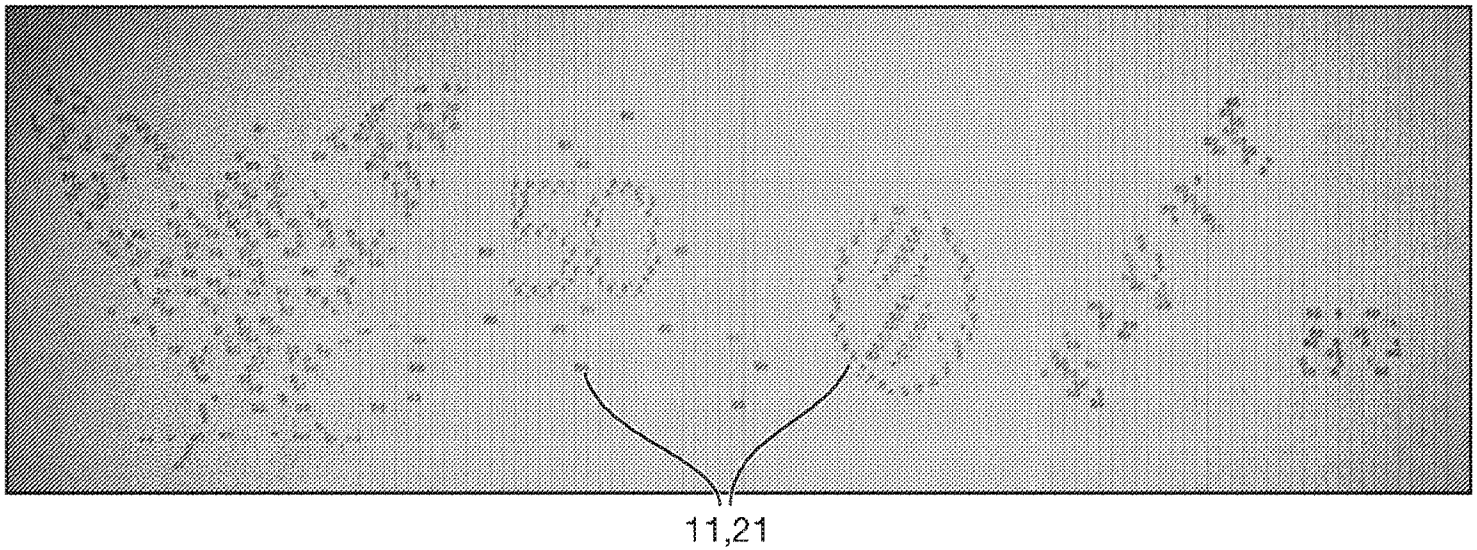
Figure 5B:
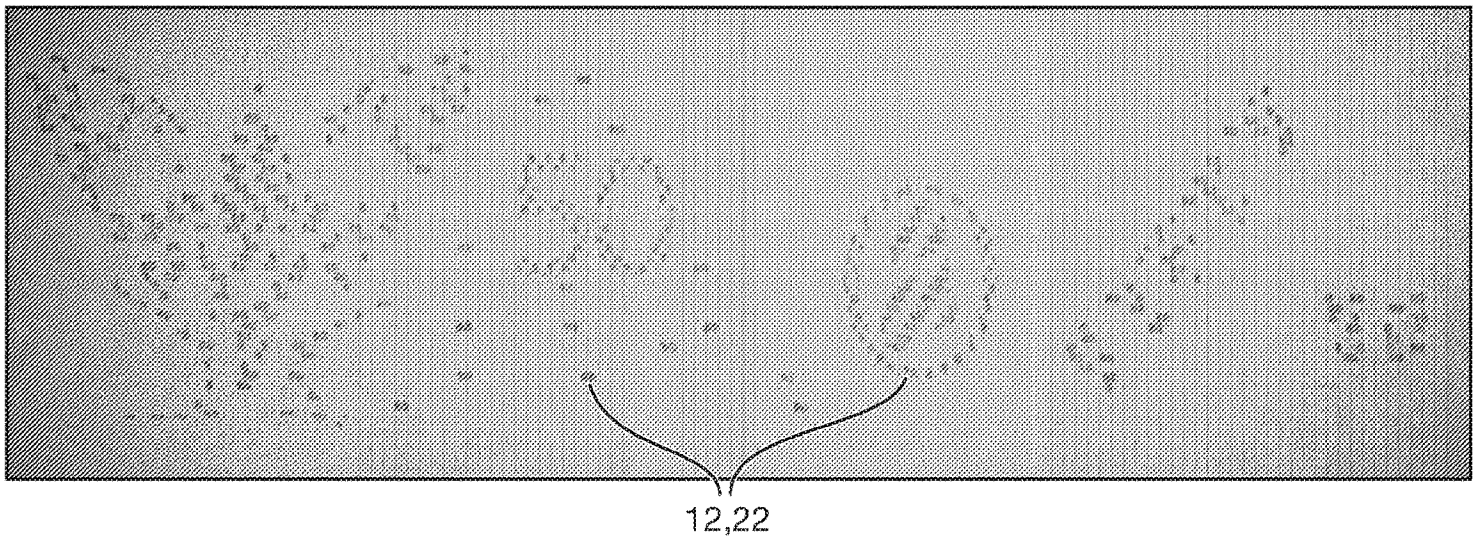
Figure 5C:
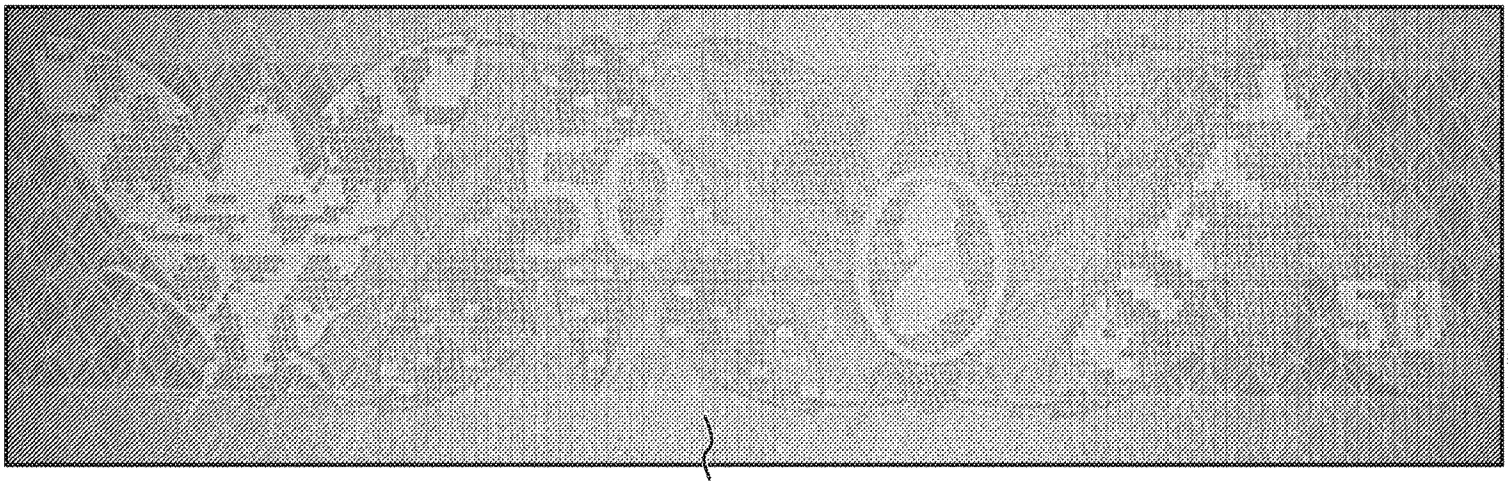
Figure 5D:
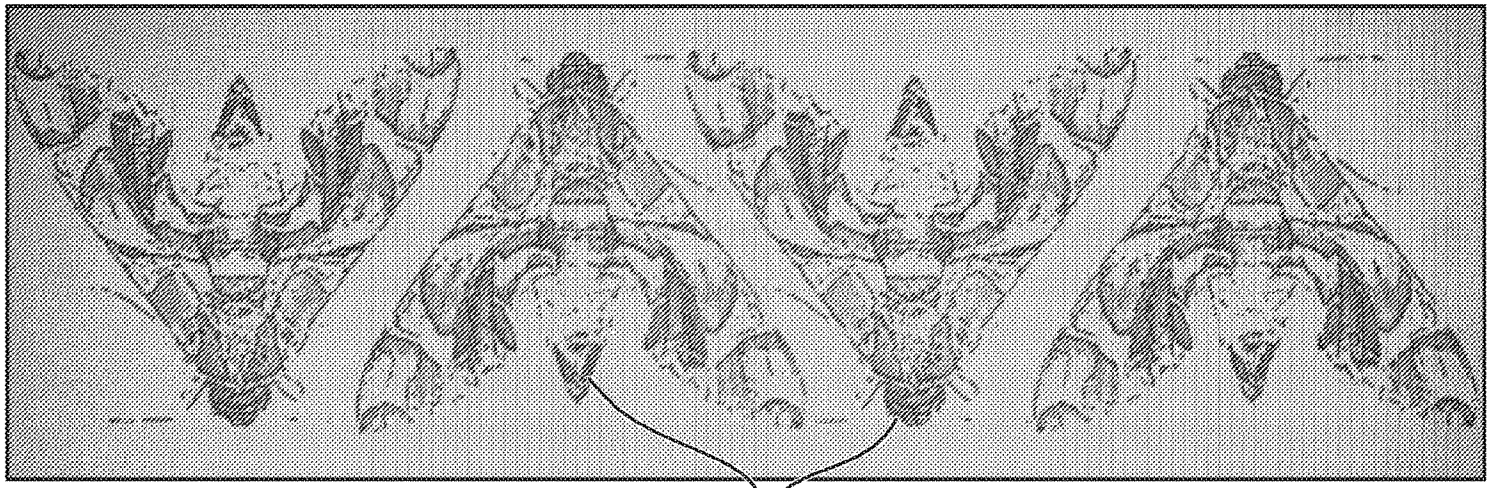
Figure 5E:
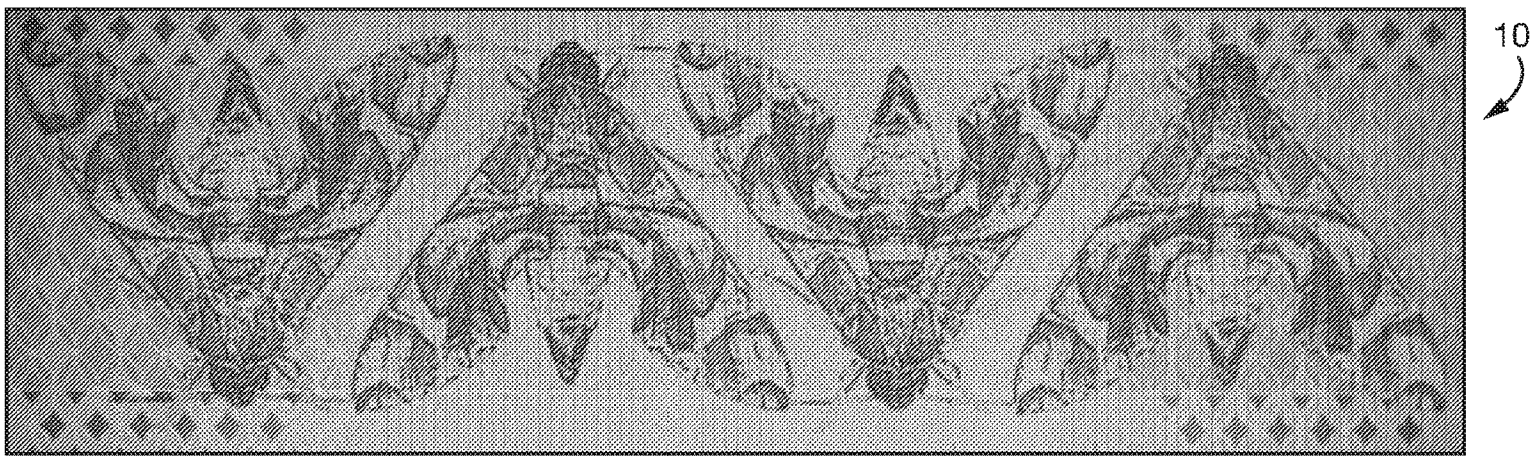
Figure 5F:
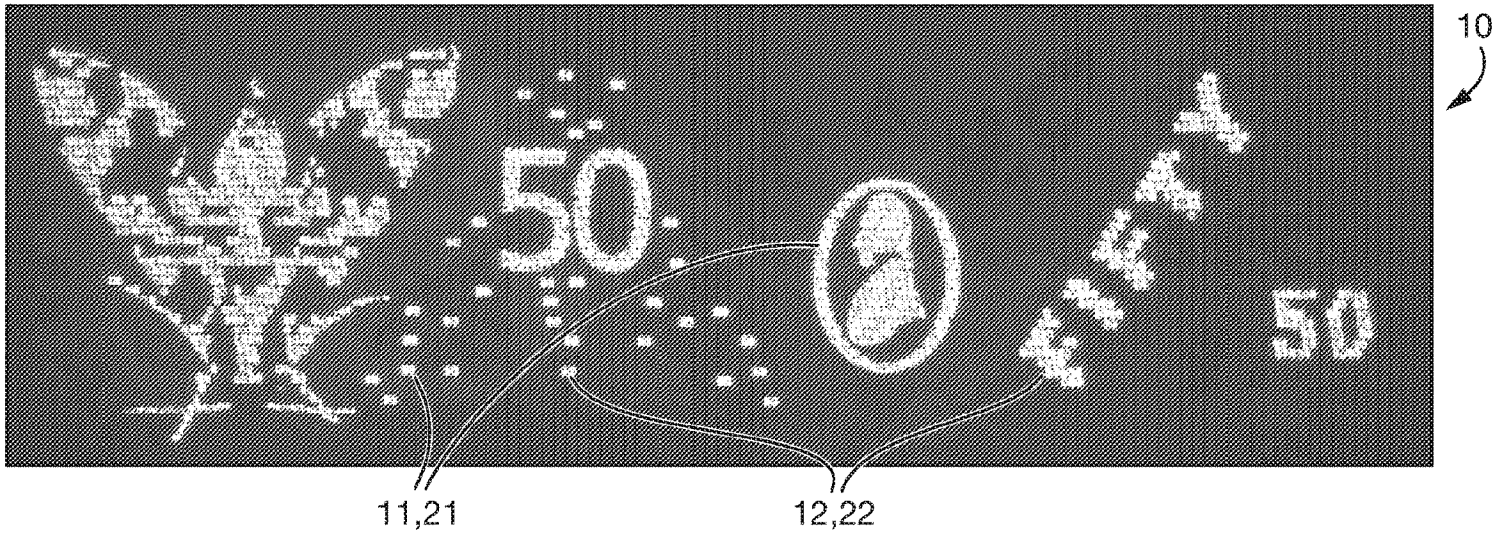
Figure 6A:
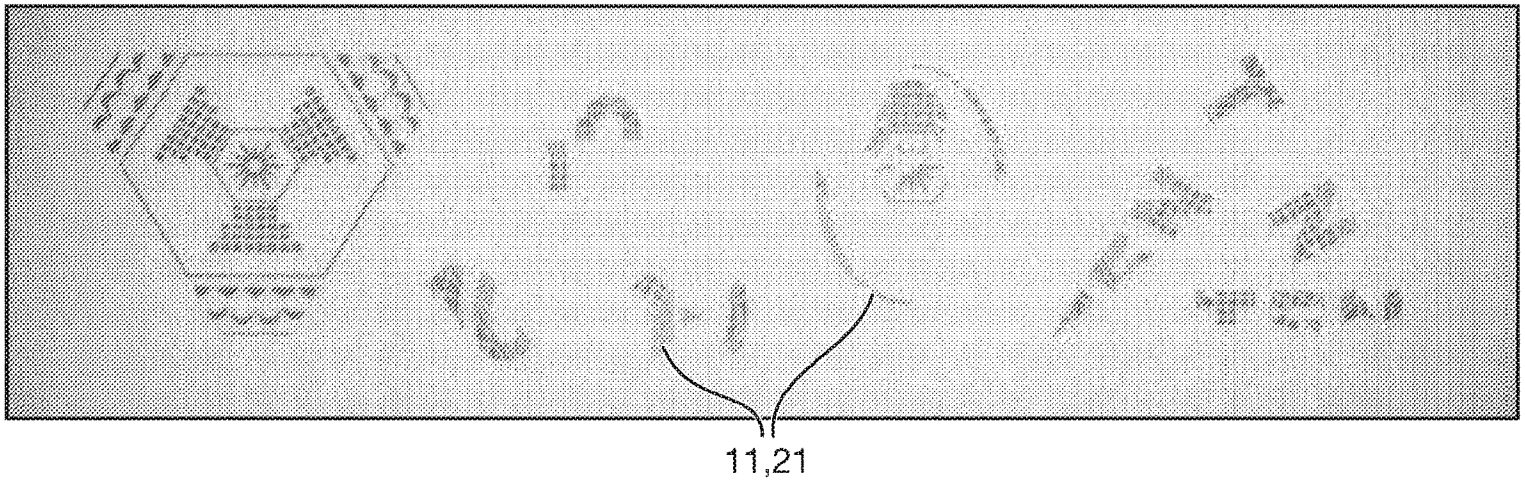
Figure 6B:
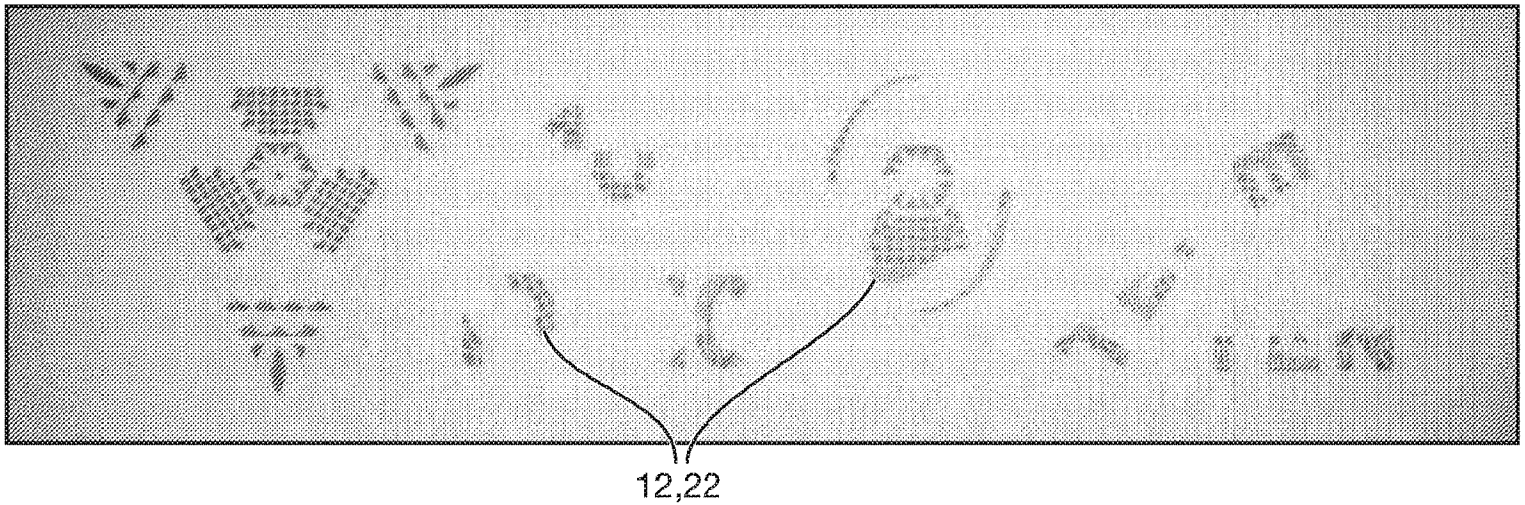
Figure 6C:
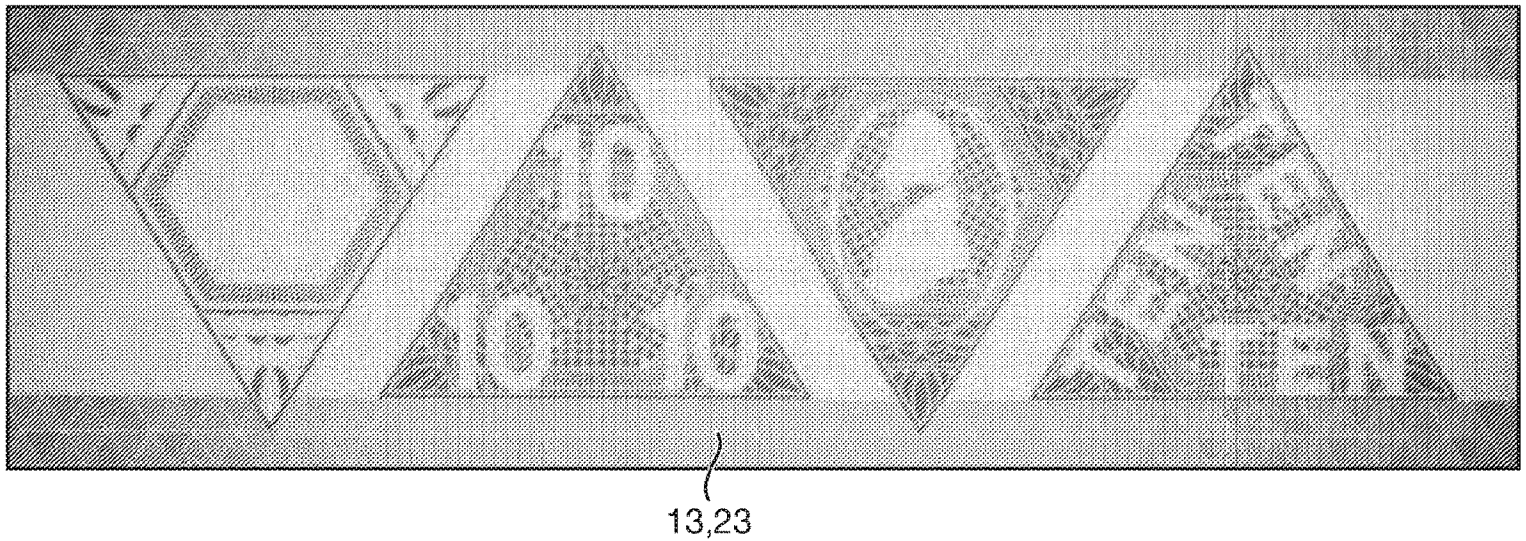
Figure 6D:
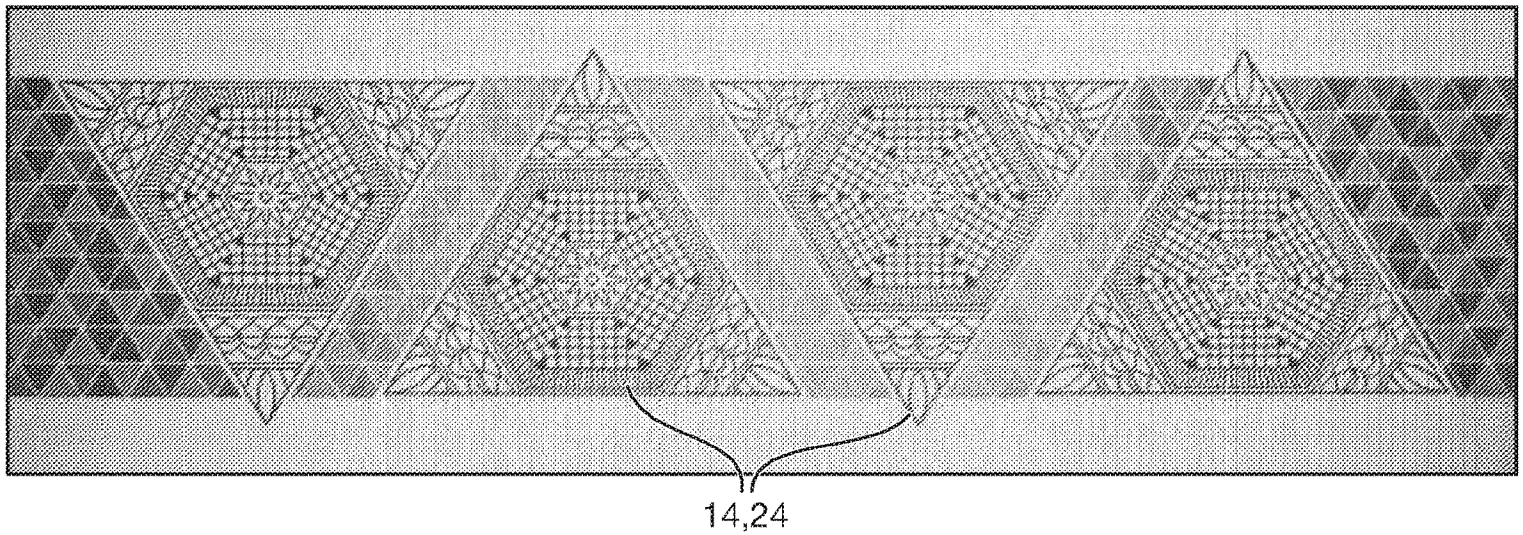
Figure 6E:
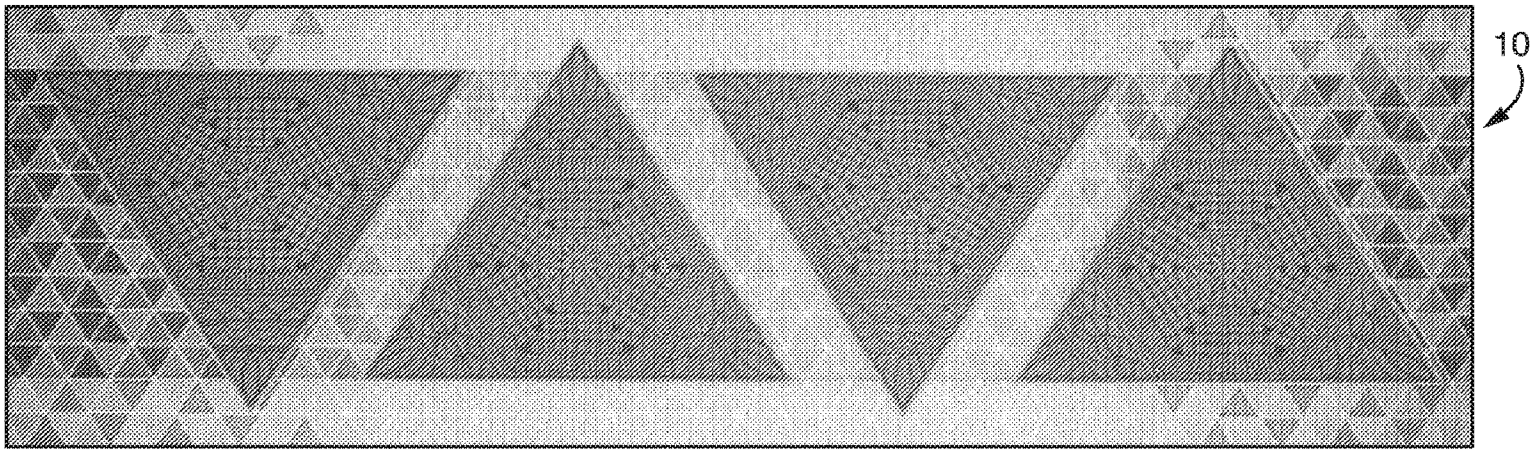
Figure 6F:
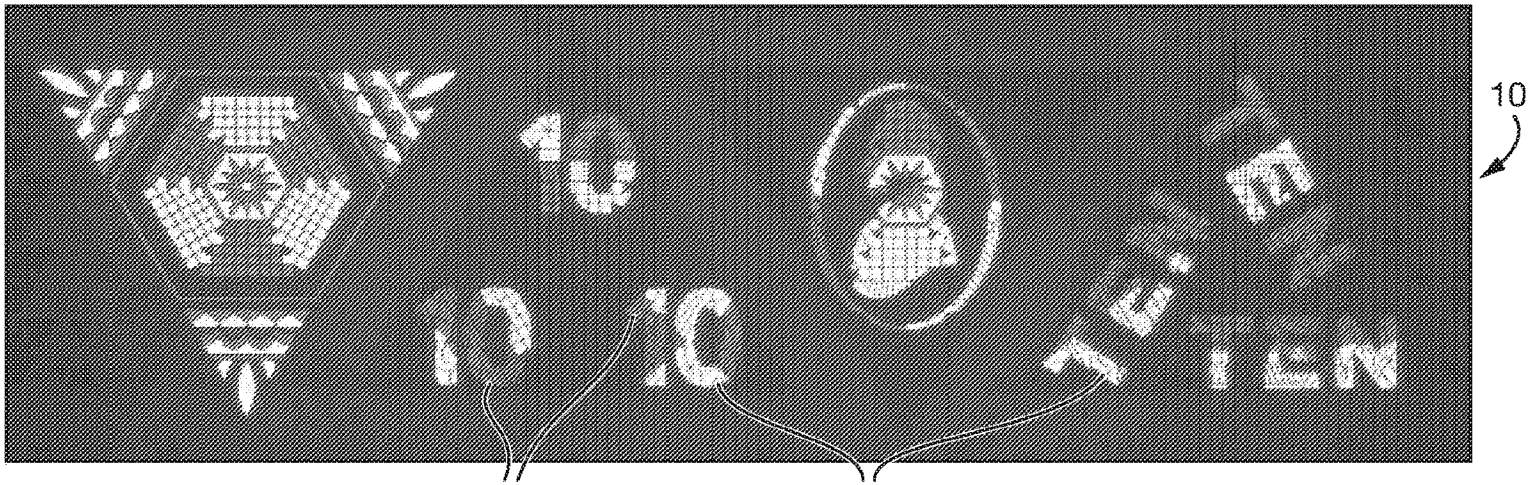

Examples of security devices, security articles, security documents and methods for their manufacture will now be described and contrasted with comparative examples thereof, with reference to the accompanying Figures, in which:

FIG. 1 schematically depicts an embodiment of a security document, in plan view;

FIGS. 2, 3, 4 and 5 respectively illustrate a first, second, third and fourth embodiment of a security device, in each case: Figure (a) depicting only a first region of the security device, Figure (b) depicting only a second region of the security device, Figure (c) depicting only a third region of the security device, Figure (d) depicting only a masking pattern of the security device, Figure (e) depicting the appearance of the complete security device when illuminated under visible light only, and Figure (f) depicting the appearance of the complete security device when illuminated under a combination of visible and UV light;

FIG. 6 illustrates a comparative example of a security device: Figure (a) depicting only a first region of the security device, Figure (b) depicting only a second region of the security device, Figure (c) depicting only a third region of the security device, Figure (d) depicting only a masking pattern of the security device, Figure (e) depicting the appearance of the complete security device when illuminated under visible light only, and Figure (f) depicting the appearance of the complete security device when illuminated under a combination of visible and UV light; and FIGS. 7 and 8 schematically depict two examples of processing lines with which security devices according to embodiments of the invention may be manufactured.

Security devices in accordance with examples of the present invention can be utilised for confirming the authenticity of any object of value (including clothing, computer equipment, food etc.) but are particularly well suited for use on security documents including banknotes, passports and the like. FIG. 1 shows an exemplary security document 1 in the form of a banknote, which may comprise a substrate of paper, polymer or a combination of the two (a hybrid paper-polymer banknote). The security document 1 in this case is provided with two security elements 10*a*, 10*b* each in accordance with embodiments of the present invention. Security element 10*a* is disposed on a security article 2, here in the form of a security thread or stripe which is arranged to be exposed through the substrate of the security document 1 at each of a series of windows. The manner in which the security article is incorporated into the substrate will depend on the nature of the security article and of the substrate. For instance if the substrate is of paper, the security article 2 may be incorporated into the substrate during paper-making and left exposed in the windows on one or both sides of the substrate, e.g. using methods as disclosed in EP0059056 or EP-A-1141480. Alternatively the security article 2 may be adhered to one surface of the substrate and exposed through apertures made through the substrate before or after application of the security device. If the substrate is transparent (e.g. polymer), the security device may be affixed to one surface and exposed through transparent regions of the substrate on the other. In still further examples the security article could be a patch or foil affixed to a surface of the substrate inside or outside a window region so as to be viewed from the same side, e.g. by adhesive and/or hot or cold stamping. This applies to opaque, translucent or transparent substrates. The security device 10*b*, on the other hand, is formed directly on the substrate of the security document 1, e.g. by printing directly thereon. It will be appreciated that in all cases there may be intervening layers between the security device 10*a*, 10*b* and the substrate on which it is ultimately carried, such as primer layers or other graphics layers, such as a security print background on a banknote. The security device could also be printed directly onto a window region of either a polymer or paper document such as a banknote.

FIGS. 2(*a*) to (*f*) illustrate a first embodiment of a security device 10 in accordance with the present invention. The complete security device 10 comprises four inks (an ink being a composition comprising a binder carrying appropriate dyes and/or pigments as necessary to exhibit the desired colour effects, of which examples will be given below). First and second inks 21, 22 are configured to exhibit substantially the same visible colour as one another when illuminated with visible (preferable white) light only, in the absence of UV wavelengths. For example, the first and second inks 21, 22 may both appear red to the naked eye under these illumination conditions. Under illumination at least one ultraviolet wavelength (in combination with visible light), however, the first and second inks 21, 22 luminesce and each exhibit a visible colour which is different from each other and from their non-luminescent colour. For example, the first ink 21 may appear yellow and the second ink 22 may appear either orange or green under these conditions.

The third ink 23 is a non-luminescent ink which exhibits substantially the same visible colour when illuminated with visible light only as the non-luminescent colour of the first and second inks 21, 22. Hence, in the above example, the third ink 23 will appear red in visible (preferably white) light. The third ink 23 does not respond to UV wavelengths and hence does not undergo a colour change when UV illumination is introduced.

The fourth ink 24 is also non-luminescent and exhibits a different colour from the non-luminescent colour of the first, second and third inks 21, 22, 23 when viewed under visible light only. For instance, in the above example, the fourth ink 24 may be black, brown or a darker shade of red as compared with the non-luminescent colour of the first, second and third inks. It is preferred that the fourth ink 24 is darker in colour than the non-luminescent colour of the first, second and third inks since this has been found to be more effective, but this is not essential. In practice the fourth ink 24 can be of any colour which is noticeably different (to the naked human eye) from the non-luminescent colour of the first, second and third inks in terms of hue (chromacity), tone (lightness/darkness) or both.

As mentioned above, in preferred embodiments, any two colours exhibited by the inks may be considered substantially the same if the distance $\Delta E_{ab}$ between the colours in CIELAB colour space is less than 3, more preferably less than 2.3. Conversely, if the distance $\Delta E_{ab}$ between the colours in CIELAB colour space is greater than or equal to 3, more preferably greater than or equal to 2.3, the colours are preferably considered different from one another.

The first and second inks 21, 22 are disposed in respective first and second regions 11, 12 of which examples are shown in FIGS. 2(*a*) and 2(*b*) respectively. Thus, in this embodiment, the first region 11 comprises a contiguous area in the form of the digit "1", and the second region 12 comprises a contiguous area in the form of the digit "0". The first and second regions 11, 12 are laterally offset from one another and in this case are spaced from one another, so as to form the digit "10" together. The third ink 23 is disposed in a third region 13 which is also laterally offset from the first and second regions 11, 12 and in this example forms a circular area surrounding the first and second regions 11, 12. Hence, in this case the third region 13 abuts each of the first and second regions. However in other cases a gap may be provided along the region peripheries so that all the regions are spaced from one another. The gap may be left unprinted (i.e. carrying no ink), or could carry a different ink, possibly the same as the fourth ink. Preferably any such spacing between the regions will be small so that it is not readily noticeable. For instance in preferred embodiments, at some locations the spacing between the regions will be less than 1 mm, more preferably less than 0.5 mm.

Together, the first, second and third regions 11, 12 and 13 form a continuous pattern which all appears to be formed of a single ink (in visible light) due to the non-luminescent colours of the first, second and third inks 21, 22, 23 being substantially the same. In this case the continuous pattern is a substantially solid printed circle. However it should be noted that the continuous pattern does not need to be spatially continuous but could include gaps such as the optional spacing between the regions mentioned above. What is meant by the term "continuous pattern" is the entire pattern created by the first, second and third inks in combination, whatever its layout.

The fourth ink 24 is configured as a masking pattern 14 which in this case comprises a set of straight, radial lines emanating from the centre of the security device as shown in FIG. 2(*d*). The fourth ink 24 overlaps parts of at least the first region 11 and/or the second region 12, and in this case overlaps parts of both as well as parts of the third region 13. Further, in this example the masking pattern 14 includes elements which cross over some of the peripheries of the regions 11, 12, 13, thereby obscuring portions of the peripheries, which is preferred but not essential.

FIG. 2(*e*) depicts the appearance of the complete security device 10 under visible (preferably white) light in the absence of UV wavelengths. In this example, the security device appears as a solid circle in the non-luminescent colour of the first, second and third inks (e.g. red), overlaid with the masking pattern 14 in another colour (e.g. brown). The boundaries of the first, second and third regions 11, 12, 13 are shown in dashed lines for reference but these will typically not be visible unless a spacing is included in the design as mentioned above. The masking pattern 14 formed by the fourth, contrasting ink 24 helps to disguise the fact that the circular area underneath (the continuous pattern) is formed of more than one ink in different regions, which might otherwise be apparent due to slight differences in the colour and/or gloss levels of the first, second and third inks 21, 22, 23. This is firstly a result of the masking pattern 14 presenting another, noticeably different colour to the viewer which will diminish any difference between the three similarly coloured inks 21, 22, 23. Additionally, in this example the masking pattern conceals parts of the region peripheries and so helps to hide their presence as well as causing visual confusion which distracts from the presence of the three regions.

FIG. 2(*f*) schematically shows the appearance of the security device 10 under combined visible light and at least one UV wavelength to which both the first and second inks 21, 22 are responsive. Now, the first and second regions are visibly distinct from the rest of the circle (the continuous pattern), so the digit "10" they form is revealed. Moreover, the appearance is multi-coloured since the first region 11 forming the digit "1" appears a different colour from the second region 12 forming the digit "0". For instance, the digit "1" may appear yellow while the digit "0" may appear either orange or green. The surroundings formed in this case by the third region 13 will not luminesce and so, depending on the intensity of visible light may appear dark but either way will not undergo a colour change (and so if sufficient visible illumination remains, will stay red in this example). Depending on the opacity of the fourth ink 24 (which also does not luminesce), the masking pattern 14 may obscure portions of the luminescing first and second regions 11, 12 as illustrated by the white lines passing therethrough in FIG. 4(*f*).

FIG. 3 illustrates a second embodiment of a security device which operates on the same principles but in which the various regions and masking pattern are arranged differently. As in the first embodiment, the security device comprises first, second and third inks 21, 22, 23 in respective regions 11, 12, 13, which all exhibit substantially the same non-luminescent colour (e.g. red) in visible illumination. The first and second inks 21, 22 exhibit different luminescent colours in response to at least one UV wavelength while the third ink 23 is not responsive to UV. A fourth ink 24 forming a masking pattern 24 in a contrasting colour is also provided. FIGS. 3(*a*), (*b*) and (*c*) depict the first, second and third regions 11, 12, 13 respectively and it will be seen that in each case the region comprises a plurality of sub-regions 11*a, b*; 12*a, b*; 13*a, b* (only two sub-regions are labelled in each case for clarity). In this example all of the sub-regions are pattern elements of the same shape, here a circle (or dot). The sub-regions are all arranged on the same regular grid so that in combination they form a periodic array of (circular) pattern elements as seen in FIG. 3(*e*). This continuous pattern appears to be formed of a single ink but in fact some of the pattern elements will be formed by the first ink 21, some of the second ink 22, and some of the third ink 23. It will be noted that in this case not only the sub-regions within each individual region 11, 12, 13 are spaced from one another (by an unprinted area or a contrasting colour) but also the sub-regions of one region are spaced from those of the other regions such that the regions themselves are spaced. Again, preferably the spacing is small, e.g. 1 mm or less.

The masking pattern 14 formed of fourth ink 24 is shown in FIG. 3(*d*) and here this comprises a regular array of triangular pattern elements. The fourth ink may be of any different colour from that of the first, second and third inks in visible light, e.g. black, brown or darker red.

The complete security element 10, as viewed under visible illumination, is depicted in FIG. 3(*e*) and it will be seen that the masking pattern 14 interlocks with the continuous pattern formed by the first, second and third regions 11, 12, 13 in such a way that a (triangular) pattern element of the masking pattern appears within and between each (circular) pattern element. The resulting effect is a complex but spatially substantially uniform pattern of, for example, red circles and black triangles. The masking pattern 14 conceals the presence of three different inks 21, 22, 23 making up the continuous pattern of circular elements and in this case this is achieved by visual distraction and the presentation of a distinct colour preventing a direct comparison between the appearances of the three inks 21, 22, 23. In this example the masking pattern 14 does not overlap any of the region peripheries but it could be modified to do so which would further enhance the obscuring effect.

FIG. 4(*f*) shows the appearance of the complete security device 10 when viewed under a combination of visible light plus at least one UV wavelength to which the first and second inks 21, 22 are responsive. Now, the configuration of the first and second regions 11, 12 is revealed. Thus the device 10 exhibits a luminescing area in the form of a triangle, of which the outer part is formed by sub-regions of the first region 11 in the first ink 21 and hence appear in one colour, e.g. yellow, while the inside part is formed by sub-regions of the second region 12 in the second ink 22 and so appear in a second colour, e.g. orange or green. The surroundings, formed by the third region 13 and the unprinted area, do not luminesce and hence appear either dark or in their original colour(s).

Again, depending on the opacity of the fourth ink 24 this may locally suppress the luminescence of the first and second regions as represented by the white triangles in FIG. 4(*f*).

It will be appreciated that while in this example the pattern elements formed by the first, second and third regions are circles and those of the masking pattern are triangles, the same principles can be applied with pattern elements of any shape, including lines, squares, geometric shapes, symbols or indicia including alphanumeric characters and currency identifies (e.g. £, $, € (etc.). It is also possible to introduce a spatial modulation to either or both of the patterns, e.g. to introduce variations in tone from one area of the pattern to another. This can be achieved by varying the size, line width or ink density of the pattern elements from one location to another, for instance. In this way, either or both patterns can be configured to exhibit information e.g. in the form of a halftone image such as a portrait or other graphic. Examples of such graphics formed of two overlapping patterns in this way can be found in WO-A-2011/135344, in which the screened working comprising indicia could instead be formed of the presently disclosed first, second and third inks, with the fourth ink masking pattern being formed as the other screened working disclosed therein.

Whilst in the two above embodiments, the non-luminescent colour of the first, second and third inks 21, 22, 23 has been exemplified as red, with the first ink 21 appearing yellow in the presence of UV illumination and the second ink 22 appearing orange or green, any combination of colours can be implemented through appropriate design of the ink compositions.

Another example of suitable ink formulae for use in these embodiments is set out described below although some adjustments may be necessary as will be readily understood by a person skilled in the art to achieve an acceptable colour match. In this case the non-luminescent colour of the first, second and third inks is red, with the first ink 21 appearing green under combined visible and UV illumination, and the second ink 22 appearing orange. It will be noted that in these cases the ink composition includes one or more visible (non-luminescent) pigments or dyes in addition to the luminescent material, which will typically be necessary unless the luminescent materials have the desired visible body colour. In these examples, each pigment or dye is supplied in the form of a base ink which also includes a binder (ink vehicle) of conventional composition, although this could be added separately. Also included in this case are additives such as driers, to improve the performance of the ink, which are optional.

First Ink 21 (Red Ink Luminescing Green)

| | |
|---|---|
| 9C3002B Bluish Red Base ink (ex SICPA) | 16.8% |
| 9H0011B Transparent White Base ink (ex SICPA) | 32.8% |
| 9C5033B Yellowish Green Fluorescent Base ink (ex SICPA) | 49.7% |
| Cobalt Driers | 0.7% |

Second Ink 22 (Red Ink Luminescing Orange)

| | |
|---|---|
| 9C3002B Bluish Red Base ink (ex SICPA) | 16.8% |
| 9H0011B Transparent White Base ink (ex SICPA) | 32.8% |
| 9C1979B Yellow Fluorescent Base ink (ex SICPA) | 49.7% |
| Cobalt Driers | 0.7% |

Third Ink 23 (Red Non-Luminescent Ink)

| | |
|---|---|
| 9C3002B Bluish Red Base ink (ex SICPA) | 17.7% |
| 9H0011B Transparent White Base ink (ex SICPA) | 29.9% |
| 9N0010B Transparent White Base ink (ex SICPA) | 2% |
| 9C1000B Greenish Yellow Base ink (ex SICPA) | 49.7% |
| Cobalt Driers | 0.7% |

In this scenario, the fourth ink could be any non-luminescent ink of a different colour, e.g. brown. An exemplary composition for the fourth ink is:

Fourth Ink 24 (Brown Non-Luminescent Ink)

| | |
|---|---|
| 9C1000B Greenish Yellow Base ink (ex SICPA) | 20.0% |
| 9C2000B Orange Base ink (ex SICPA) | 32.7% |
| 9C3002B Bluish Red Base ink (ex SICPA) | 23.1% |
| 9C7009B Black IR-Transparent Base ink (ex SICPA) | 21.2% |
| 9H0011B Transparent White Base ink (ex SICPA) | 1.0% |
| Cobalt Driers | 2.0% |

The exemplary first and second inks 21, 22 described above are responsive to substantially all UV wavelengths in the range 235 to 380 nm and so both inks will display the desired colour change when illuminated with any one UV wavelength in that range (plus visible light). However this is not essential and in other cases the first and second inks 21, 22 need only be responsive to one or more UV wavelengths, provided that they have at least one UV excitation wavelength in common.

FIGS. 4 and 5 show two further embodiments of security devices according to the present invention, illustrated using photographs of real exemplary artwork.

In the FIG. 4 embodiment, the first and second inks 21, 22 both appear light green under visible light only and appear red and yellow respectively when additionally irradiated with UV wavelengths. The third ink 23 is a non-luminescent light green ink. The fourth ink 24 is a dark green non-luminescent ink. Exemplary ink compositions suitable for use in this embodiment are as follows:

First Ink 21 (Green Ink Luminescing Red)

| | |
|---|---|
| 9C1033B Reddish Yellow Base ink (ex SICPA) | 7.0% |
| 9C5000B Green Base ink (ex SICPA) | 2.6% |
| 9H0011B Transparent White Base ink (ex SICPA) | 39.8% |
| 9C3901B Red Fluorescent Base ink (ex SICPA) | 50.0% |
| Cobalt Driers | 0.6% |

Second Ink 22 (Green Ink Luminescing Yellow)

| | |
|---|---|
| 9C1033B Reddish Yellow Base ink (ex SICPA) | 7.0% |
| 9C5000B Green Base ink (ex SICPA) | 2.7% |
| 9H0011B Transparent White Base ink (ex SICPA) | 69.7% |
| 9C1979B Yellowish Fluorescent Base ink (ex SICPA) | 20.0% |
| Cobalt Driers | 0.6% |

Third Ink 23 (Green Non-Luminescent Ink)

| | |
|---|---|
| 9C1033B Reddish Yellow Base ink (ex SICPA) | 15.4% |
| 9C5000B Green Base ink (ex SICPA) | 5.8% |
| 9H0011B Transparent White Base ink (ex SICPA) | 77.1% |
| 9N0010B Transparent White Base ink (ex SICPA) | 1.0% |
| Cobalt Driers | 0.7% |

Fourth Ink 24 (Dark Green Non-Luminescent Ink)

| | |
|---|---|
| 9C1033B Reddish Yellow Base ink (ex SICPA) | 20.85% |
| 9C4001B Greenish Blue Base ink (ex SICPA) | 53.13% |
| 9H0011B Transparent White Base ink (ex SICPA) | 6.95% |
| 9C7009B Non-Readable Black Base (ex SICPA) | 18.37% |
| Cobalt Driers | 0.7% |

As shown in FIGS. 4(*a*) and (*b*), the first ink 21 and second ink 22 are disposed in respective regions 11, 12 configured to display indicia in combination. Thus the first ink 21 forms portions of the digit "20" plus portions of a logo. For instance in the logo, the first ink forms an oval shape as well as parts of a silhouette of a person inside the logo. The second ink 22 is arranged to provide the missing parts of the digit "20" as well as those of the logo. In a variation of this design, the first and second regions could be arranged to partially overlap one another where the two inks meet. The third ink 23 is arranged in a third region 13 and configured in the form of a fine line security print pattern missing portions corresponding to the first and second regions 11, 12. Hence a portion in the shape of the digit "20"

and of the same logo are excluded from the third region 13. The first and second regions 11, 12 fill in these missing portions so as to create the appearance of a continuous pattern in light green ink. The masking pattern 14 formed of fourth ink 24 is shown in FIG. 4(*d*) and in this case comprises multiple substantially triangular regions of complex guilloche line structures without any particular relation to the first and second regions, though designed to complement the security print pattern in the third region. In this case the masking pattern 14 overlaps portions of the first, second and third regions.

FIG. 4(*e*) shows the appearance of the complete security device 10 in visible light (only). The masking pattern 14 dominates the appearance of the device although the continuous pattern formed by the first, second and third inks is also visible behind. The masking pattern disguises the fact that this continuous pattern is formed of more than one ink.

Under combined visible and UV light, as shown in FIG. 4(*f*), the first and second regions 11, 12 are now visibly distinct from the remainder of the device, appearing red and yellow respectively. Thus a multi-coloured version of the digit "20" and of the logo are revealed. If the first and second inks were designed to partially overlap one another, a third UV colour (orange, arising from the mixture of red and yellow) would be exhibited in the regions of overlap, further enhancing the complexity of the device.

In the FIG. 5 embodiment, the first and second inks 21, 22 both appear light pink under visible light only and appear green and orange respectively when additionally irradiated with UV wavelengths. The third ink 23 is a non-luminescent light pink ink. The fourth ink 24 is a dark pink non-luminescent ink.

As shown in FIGS. 5(*a*), (*b*) and (*c*), the first ink 21, second ink 22 and third ink 23 are disposed in respective regions 11, 12 and 13 each of which comprise multiple sub-regions each in the form of microtext exhibiting either the digit "5", "0" or "50" (at least in areas of the device). Each "50" is a pattern element arrayed on a regular grid so that in combination the three inks produce a continuous array of "50's". The first ink 21 contributes a subset of the pattern elements which include selected "0's" of the pattern defining a macroscale image of the same digit "50" as well as selected "50's" of the pattern which form parts of a logo as well as parts of the word "FIFTY". The second ink 22 contributes another subset of the pattern including selected "5's" which combine with the "0's" of the first ink to complete the macroscale digit "50" and also selected "50's" which complete the logo and the word "FIFTY. In other areas the first and second regions contribute pattern elements to areas which shade in portions of an image of a moth, the remainder being filled in by the third region 13. The third region 13 also defines three further moth images through half toning of the "50" 's it contributes to the pattern in those areas.

As shown in FIG. 5(*d*), the masking pattern 14 comprises four complex line images of moths. In this case the masking pattern 14 overlaps portions of the first, second and third regions.

FIG. 5(*e*) shows the appearance of the complete security device 10 in visible light (only). The masking pattern 14 dominates the appearance of the device although the continuous pattern formed by the first, second and third inks is also visible behind. These two layers combine to give the appearance of four multi-tonal moth images. The masking pattern 14 disguises the fact that the background pattern is formed of more than one ink.

Under combined visible and UV light, as shown in FIG. 5(*f*), the first and second regions 11, 12 are now visibly distinct from the remainder of the device, appearing green and orange respectively. Thus new indicia are revealed, including the macroscale digit "50", the logo and the word "FIFTY" which in each case are multi-coloured. The left most moth image now also appears multi-coloured.

Of course, the FIG. 5 embodiment could alternatively be implemented in different colours, e.g. using the inks described in relation to any of the preceding embodiments.

For completeness, FIG. 6 depicts a comparative example of a security device which also comprises four inks, each of the sort described in the preceding embodiments, although in this case the fourth ink 24 does not achieve as great a masking effect since it does not overlap either of the luminescent inks 21, 22.

As before, FIGS. 6(*a*), (*b*) and (*c*), show that the first ink 21, second ink 22 and third ink 23 are disposed in respective regions 11, 12 and 13 each of which comprise multiple sub-regions, here in the form of geometric shapes which together form a tiled pattern with gaps between each sub-region. The first and second inks 21, 22 each form parts of macroscale digits "10", a logo and the words "TEN" as well as a decorative pattern. The third ink 23 fills in the remaining areas with a corresponding pattern in substantially the same colour, resulting in four triangular areas displaying an unprinted line pattern inside each one.

FIG. 6(*d*) shows the masking pattern 14 formed of a fourth ink in a contrasting non-luminescent colour. Here, unlike the previous embodiments, the masking pattern 14 is designed to exactly match the unprinted line pattern resulting from the combination of the first, second and third inks. Hence, as shown in FIG. 6(*e*) when the complete device is viewed in visible light (only) the masking pattern 14 fills in the line pattern and each triangle appears as a solid area of one colour carrying this complex line pattern thereon.

FIG. 6(*f*) shows the appearance of the security device 10 when UV light is introduced, revealing the presence of the first and second regions. Hence multi-coloured versions of the macroscale digit "10", the logo and the word "TEN" are now exhibited. It will be noted that the line pattern corresponding to masking pattern 14 remains visible since the luminescent materials are absent in the same locations as the pattern 14.

In all of the above embodiments it is preferable that the four inks are registered to one another. That is, in a plurality of the security devices the four regions will have substantially the same relative position to one another. This significantly enhances the difficulty of counterfeiting and improves the visual effect of the device.

Exemplary methods of manufacturing the security devices will now be described with reference to FIGS. 7 and 8 both of which schematically depict suitable in-line printing apparatus by which the security devices may be produced. The four inks could be applied by any suitable printing technique, preferably lithographic, gravure, flexographic, offset or intaglio printing. Preferably at least the first, second and third ink 21, 22, 23 are applied by the same technique to minimise any visual distinction between them. The fourth ink may be applied by the same or a different technique. Nonetheless, all four inks are preferably applied to the substrate 5 in one continuous printing line in order to achieve the desired level of registration.

In the FIG. 7 embodiment, four printing stations 31, 32, 33 and 34 are arranged on the same side of the transport path for substrate 5 and each arranged to print directly onto the substrate so that the inks are applied to the substrate sequentially. Thus print station 31 is configured to apply first ink 21 onto first region 11, print station 32 to apply second ink 22 onto second region 12, print station 33 to apply third ink 23 onto third region 13 and print station 34 to apply fourth ink 24 according to the masking pattern 14. It should be appreciated that it is not essential to apply the inks to the substrate in this order, although the fourth ink 24 will need to be applied after whichever of the other inks it is required to overlap (i.e. at least after the first and/or second ink).

Whilst it is preferable for all four inks to be applied to the same side of the substrate, if the substrate is transparent or translucent (e.g polymeric), one or more of the inks could be applied to the opposite side. To illustrate this FIG. 7 shows an alternative position for print station 33 (denoted as 33') in dashed lines.

In the alternative arrangement of FIG. 8, the four print stations 31 to 34 do not apply ink directly to substrate 5 but instead onto a transfer roller or blanket 39, from which the complete security element is then applied to the substrate 5 simultaneously. In variations of this approach, only two or more of the inks are applied to the transfer roller 39 with the remainder being applied directly to the substrate 5 at additional print stations. As an example, an alternative position for print station 34 (denoted as 34') is shown in dashed lines.

In all of the above embodiments, the security element could include additional substances, preferably machine readable substances, to further increase the security level of the device. For instance, the security element could include magnetic, metallic, electrically conductive, IR absorbent or optically variable materials. Any of these could be incorporated into one or more of the above mentioned inks provided they do not impair the required visual effects. As an example, the forth ink could comprise a metallic, magnetic or optically variable ink to form the masking pattern 14. The use of a metallic or optically variable ink for this purpose is particularly advantageous since this would further distract the eye from the presence of multiple inks in the remainder of the device.

The invention claimed is:

1. A security device, comprising:

a first ink and a second ink each arranged in respective laterally offset first and second regions of the security device, the first and second inks each comprising a respective luminescent material which both luminesce in response to irradiation at at least one excitation wavelength in an ultra-violet spectrum, the first and second inks each exhibiting substantially the same non-luminescent visible colour as one another when illuminated with visible light in an absence of the at least one excitation wavelength, and the first and second inks each exhibiting visible colours which are different from the non-luminescent visible colour and from one another when illuminated with a combination of visible light and the at least one excitation wavelength;

a third ink arranged in a third region of the device laterally offset from the first and second regions of the device, the third ink not luminescing in response to the at least one excitation wavelength, and the third ink exhibiting substantially the same non-luminescent visible colour as the first and second inks when illuminated with visible light in the absence of the at least one excitation wavelength; and a fourth ink arranged in a masking pattern which partially overlaps one or more portions of the first ink in the first region and/or of the second ink in the second region, the fourth ink not luminescing in response to the at least one excitation wavelength, and the fourth ink exhibiting a different visible colour from the non-luminescent visible colour of the first, second and third inks when illuminated with visible light in the absence of the at least one excitation wavelength;

whereby when the security device is illuminated with visible light in the absence of the at least one excitation wavelength, the first, second and third regions together appear as one continuous pattern in the non-luminescent visible colour, the fourth ink obscuring a presence of more than one ink forming the continuous pattern, and when the security device is illuminated with a combination of visible light and the at least one excitation wavelength, the first and second regions become visibly distinct from each other and from a remainder of the continuous pattern.

2. A security device according to claim 1, wherein the masking pattern additionally partially overlaps one or more portions of the third ink in the third region.

3. A security device according to claim 1, wherein the masking pattern includes elements which at least partially conceal peripheries of the first, second and/or third regions.

4. A security device according to claim 1, wherein the masking pattern is configured to cause visual confusion to thereby obscure an arrangement of the first, second and third regions.

5. A security device according to claim 1, wherein the first, second and/or third region(s) comprise a plurality of sub-regions spaced from one another.

6. A security device according to claim 1, wherein at least in an area of the continuous pattern, the first and second regions are spaced from one another, by one or more gap(s) which are ink-free or of a colour contrasting with the non-luminescent colour of the first and second inks whereby at least some peripheries of the regions are visible in the continuous pattern when the security device is illuminated with visible light in the absence of the at least one excitation wavelength.

7. A security device according to claim 6, wherein the first and second regions are spaced from one another by less than 1 mm, at least at one location in the continuous pattern.

8. A security device according to claim 1, wherein at least in an area of the continuous pattern, the first and second regions abut one another.

9. A security device according to claim 1, wherein at least in an area of the continuous pattern, the first and second regions partially overlap one another.

10. A security device according to claim 1, wherein the continuous pattern formed by the first, second and third regions comprises a periodic pattern, different sub-sets of pattern elements being formed of each of the first, second and third inks.

11. A security device according to claim 10, wherein the periodic pattern is spatially modulated across the security device to provide areas of different visual contrast when the security device is illuminated with visible light in the absence of the at least one excitation wavelength, the regular or periodic pattern.

12. A security device according to claim 1, wherein the masking pattern formed by the fourth ink is configured to interlock with at least portions of the continuous pattern formed by the first, second and third inks.

13. A security device according to claim 1, wherein the first, second, third and fourth inks are each registered to one another.

14. A security device according to claim 1, wherein the first, second, third and fourth inks are each printed inks on a substrate.

15. A plurality of security devices each in accordance with claim 1, wherein the first, second, third and fourth inks are each registered to one another whereby relative positions of the first, second and third regions and of the masking pattern are substantially the same on each of the security devices.

16. A security article comprising a security device according to claim 1, wherein the security article is a security thread, stripe, patch or foil.

17. A security document comprising a security device according to claim 1, wherein the security document is a banknote, identity card, passport, cheque, stamp, visa, bond, certificate or voucher.

18. A method of manufacturing a security device, the method comprising applying onto a substrate:

a first ink and a second ink each arranged in respective laterally offset first and second regions of the security device, the first and second inks each comprising a respective luminescent material which both luminesce in response to irradiation at at least one excitation wavelength in an ultra-violet spectrum, the first and second inks each exhibiting substantially the same non-luminescent visible colour as one another when illuminated with visible light in an absence of the at least one excitation wavelength, and the first and second inks each exhibiting visible colours which are different from the non-luminescent visible colour and from one another when illuminated with a combination of visible light and the at least one excitation wavelength;

a third ink arranged in a third region of the device laterally offset from the first and second regions of the device, the third ink not luminescing in response to the at least one excitation wavelength, and the third ink exhibiting substantially the same non-luminescent visible colour as the first and second inks when illuminated with visible light in the absence of the at least one excitation wavelength; and a fourth ink arranged in a masking pattern which partially overlaps one or more portions of the first ink in the first region and/or of the second ink in the second region, the fourth ink not luminescing in response to the at least one excitation wavelength, and the fourth ink exhibiting a different visible colour from the non-luminescent visible colour of the first, second and third inks when illuminated with visible light in the absence of the at least one excitation wavelength;

whereby when the security device is illuminated with visible light in the absence of the at least one excitation wavelength, the first, second and third regions together appear as one continuous pattern in the non-luminescent visible colour, the fourth ink obscuring a presence of more than one ink forming the continuous pattern, and when the security device is illuminated with a combination of visible light and the at least one excitation wavelength, the first and second regions become visibly distinct from each other and from any remainder of the continuous pattern.

19. A method according to claim 18, wherein the first, second, third and fourth inks are applied to the substrate in registration with one another.

20. A method according to claim 18, wherein the first, second, third and fourth inks are applied to the substrate in the same, in-line application process.

* * * * *